US011332334B2

(12) United States Patent
Ji

(10) Patent No.: US 11,332,334 B2
(45) Date of Patent: May 17, 2022

(54) PAPER ROLL SUPPORT DEVICE FOR PRINTING APPARATUS

(71) Applicant: BIXOLON Co., Ltd., Seongnam-si (KR)

(72) Inventor: Min Sik Ji, Seongnam-si (KR)

(73) Assignee: BIXOLON CO., LTD., Seongnam-si (KR)

( * ) Notice: Subject to any disclaimer, the term of this patent is extended or adjusted under 35 U.S.C. 154(b) by 53 days.

(21) Appl. No.: 17/072,619

(22) Filed: Oct. 16, 2020

(65) Prior Publication Data

US 2021/0403265 A1 Dec. 30, 2021

(30) Foreign Application Priority Data

Jun. 30, 2020 (KR) ..... 10-2020-0080309

(51) Int. Cl.
*B65H 16/06* (2006.01)

(52) U.S. Cl.
CPC ..... *B65H 16/06* (2013.01)

(58) Field of Classification Search
None
See application file for complete search history.

(56) References Cited

U.S. PATENT DOCUMENTS 5,486,259 A * 1/1996 Goodwin ..... B41J 3/36 156/384
5,813,343 A * 9/1998 Harb ..... B65H 16/06 101/212
6,158,342 A * 12/2000 Moore ..... B41J 11/0045 101/407.1
6,431,492 B1 * 8/2002 Chillscyzn ..... B41J 15/042 242/577
8,870,113 B2 * 10/2014 Kuo ..... B65H 16/06 242/578
2002/0175985 A1 * 11/2002 Zevin ..... B41J 15/02 347/104
2003/0141655 A1 * 7/2003 Bryer ..... B65H 9/101 271/264
2010/0061790 A1 * 3/2010 Yu ..... B41J 15/042 400/613

FOREIGN PATENT DOCUMENTS

JP 2011-246252 * 1/2015
JP 2015-160424 * 9/2015
JP 2017-213693 * 12/2017
WO WO 2006/060228 * 6/2006

* cited by examiner

*Primary Examiner* — William A. Rivera
(74) *Attorney, Agent, or Firm* — Sughrue Mion, PLLC

(57) ABSTRACT

Disclosed herein is a paper roll support device for a printing apparatus. The paper roll support device includes: first and second paper guides arranged to be opposite to each other, and configured to support a paper roll; a support panel configured to fix the first and second paper guides; first and second transfer rods installed such that first ends thereof are fixed to the first and second paper guides, and configured to be movable in conjunction with each other; a pulley provided to be rotatable coaxially with the pinion gear; a belt installed such that one end thereof is fixed to one side of the outer circumference of the pulley and the other end thereof is fixed to one end of one of the first and second transfer rods, and configured to rotate the pulley; and an elastic member configured to reversely rotate the pulley to its original position.

16 Claims, 11 Drawing Sheets

[Fig. 1]
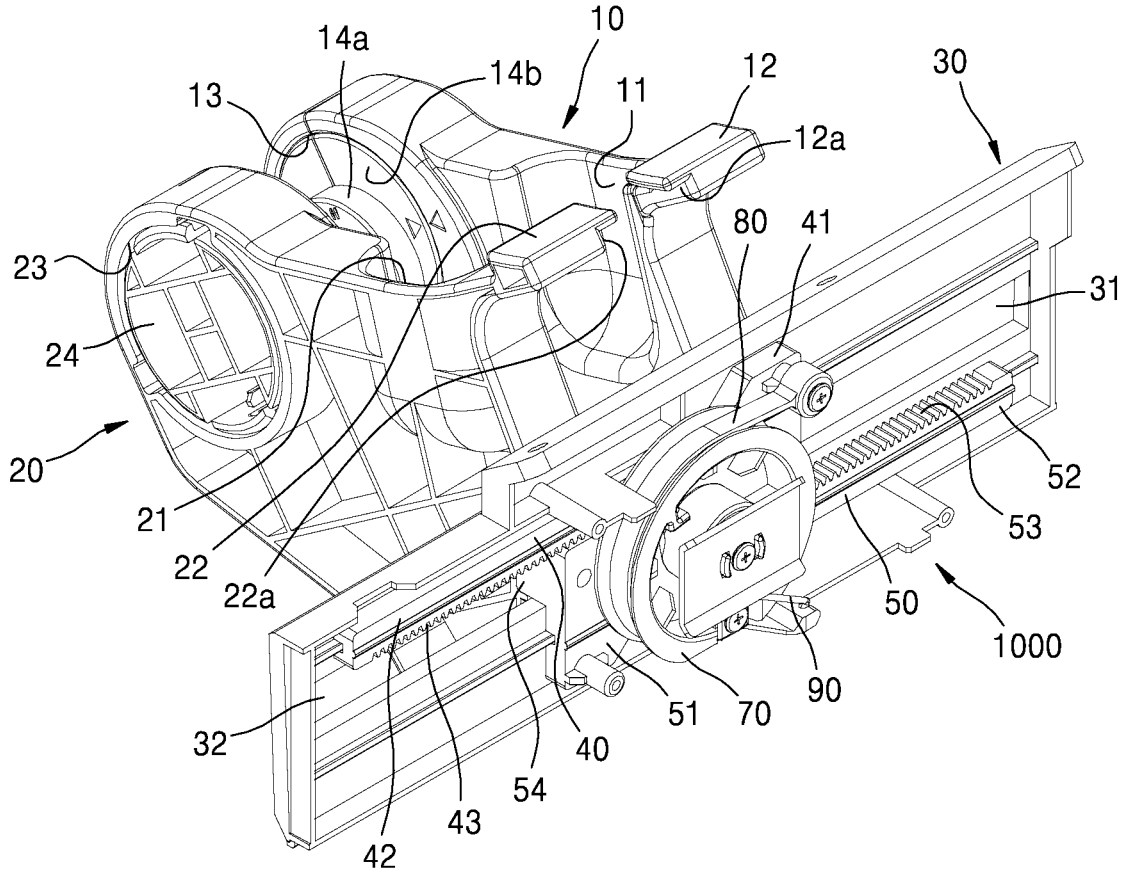

[Fig. 2]
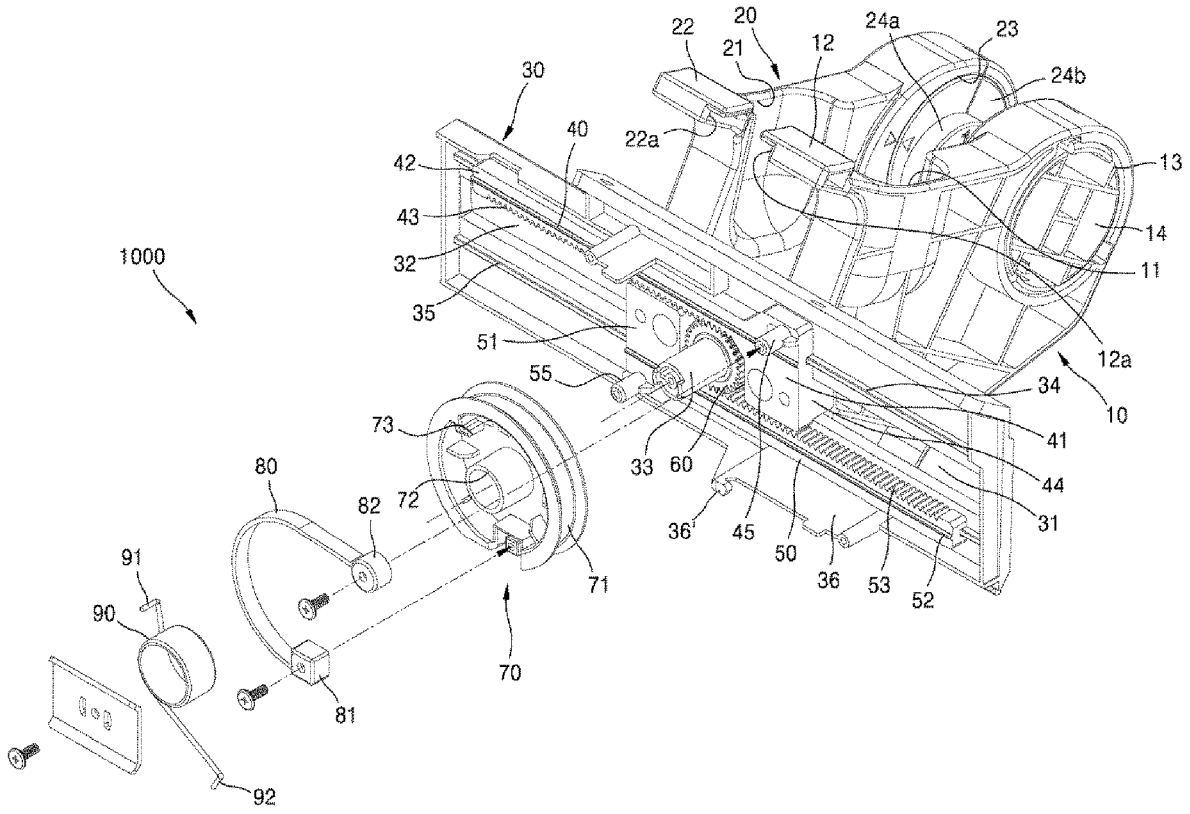

[Fig. 3]
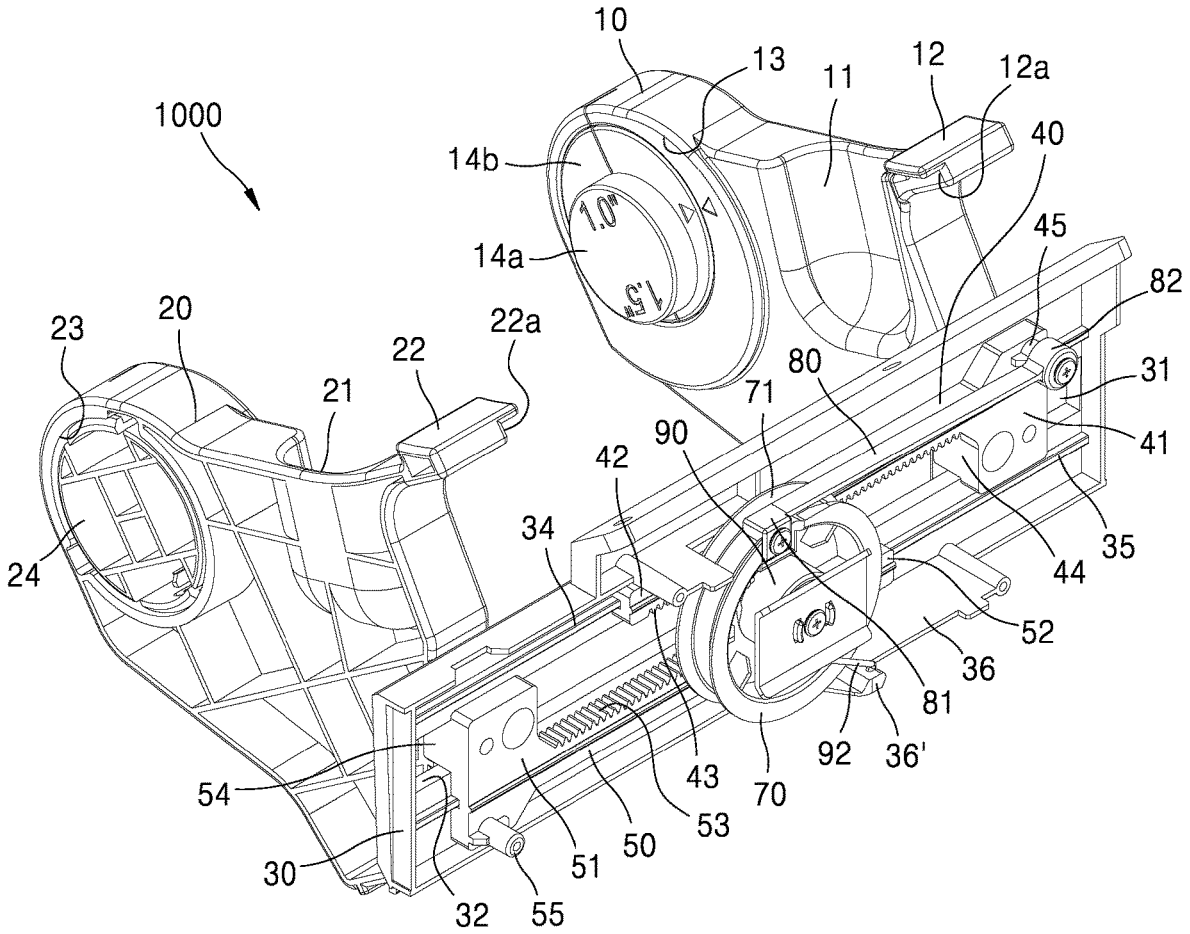

[Fig. 4]
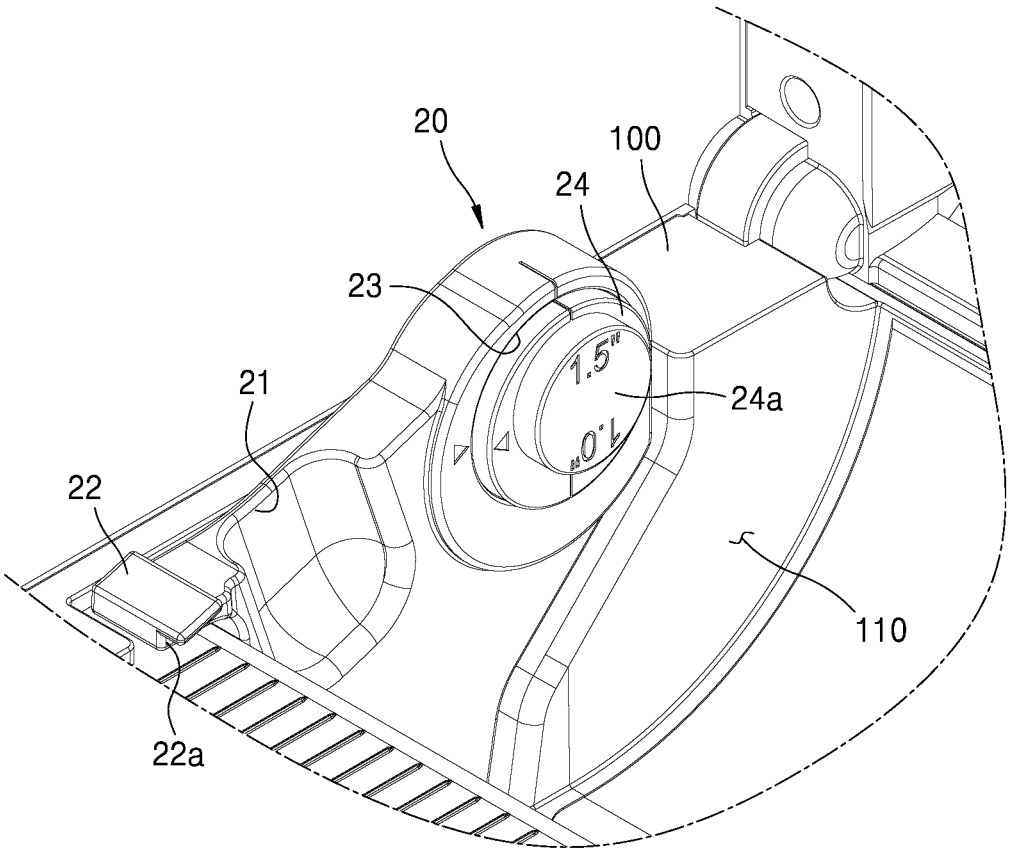

[Fig. 5]
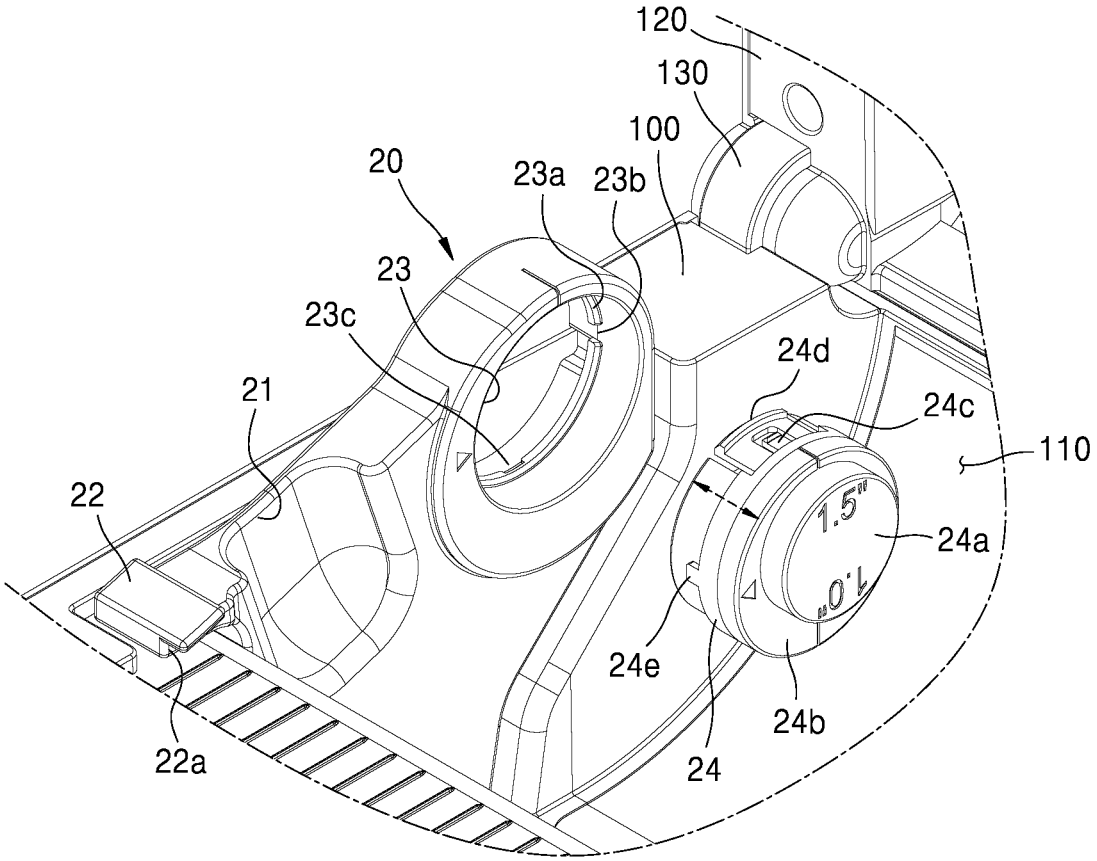

[Fig. 6]
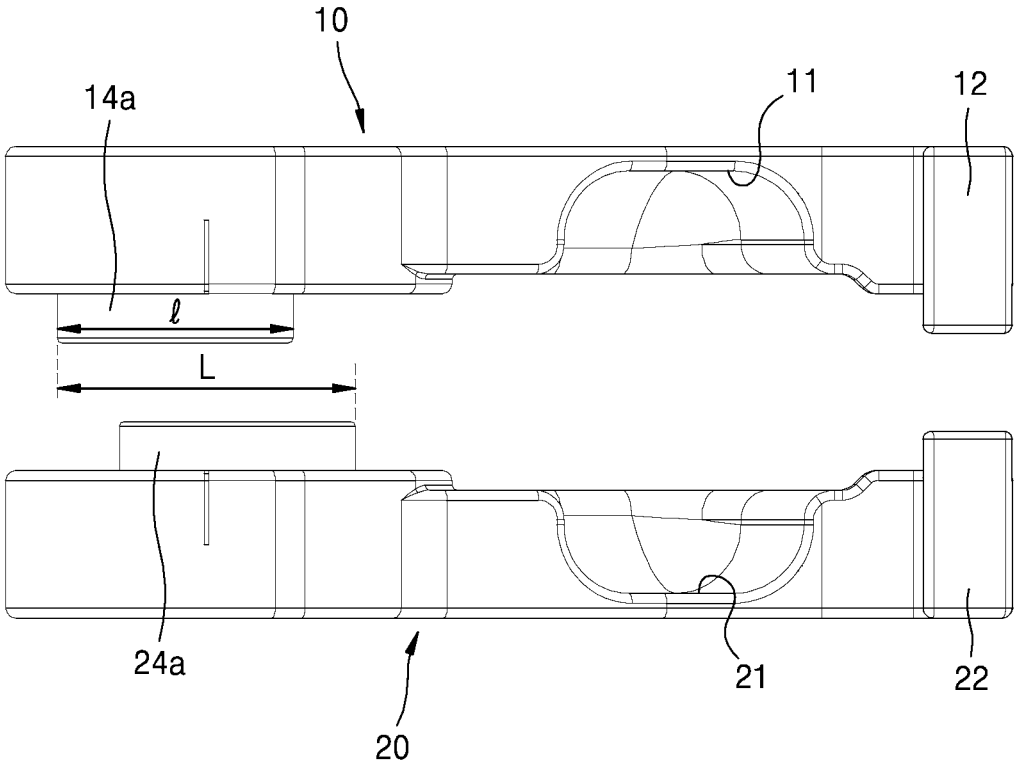

[Fig. 7]
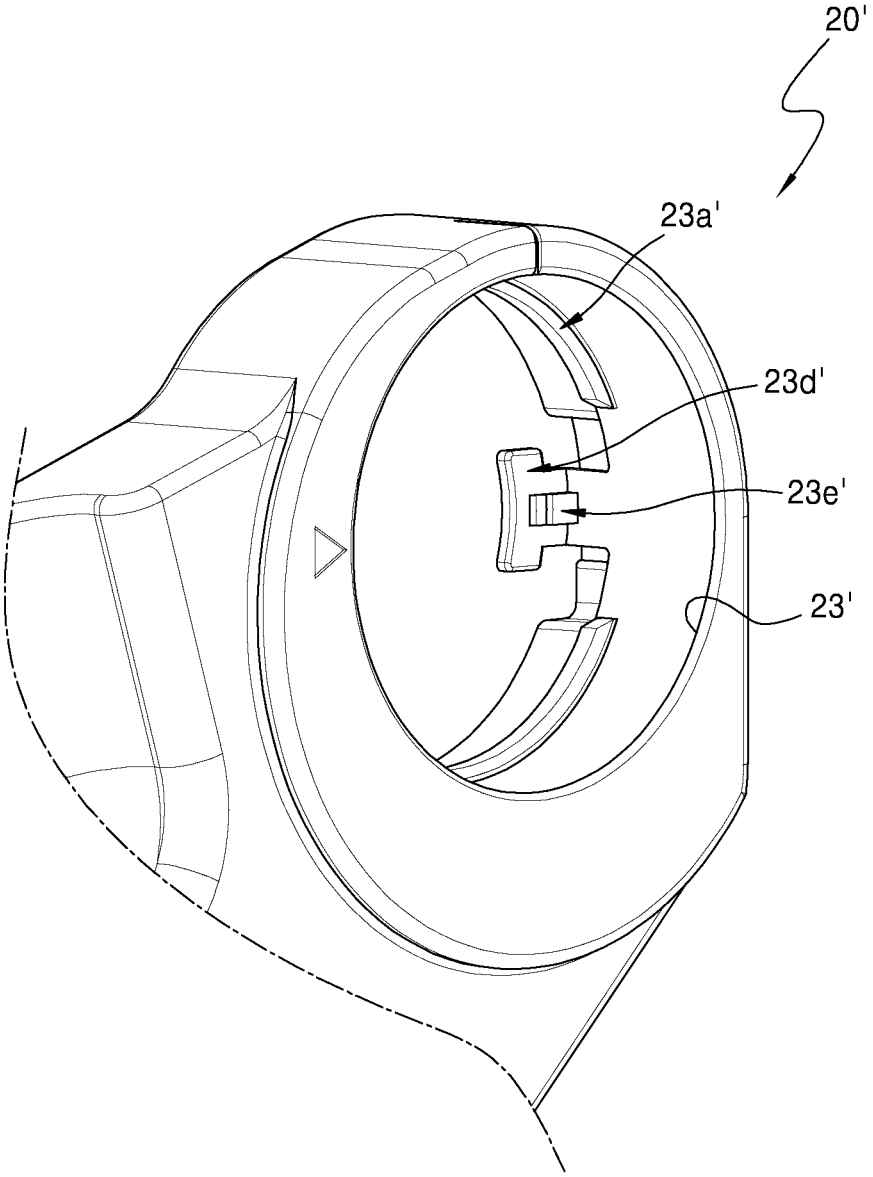

[Fig. 8]
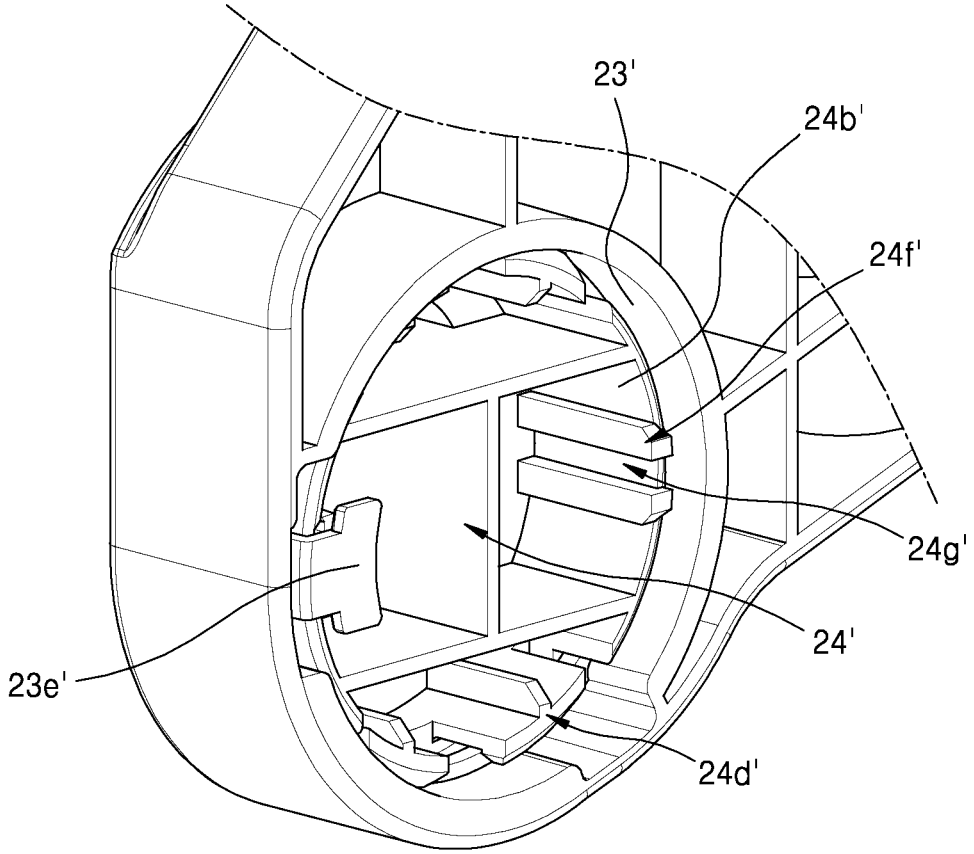

[Fig. 9]
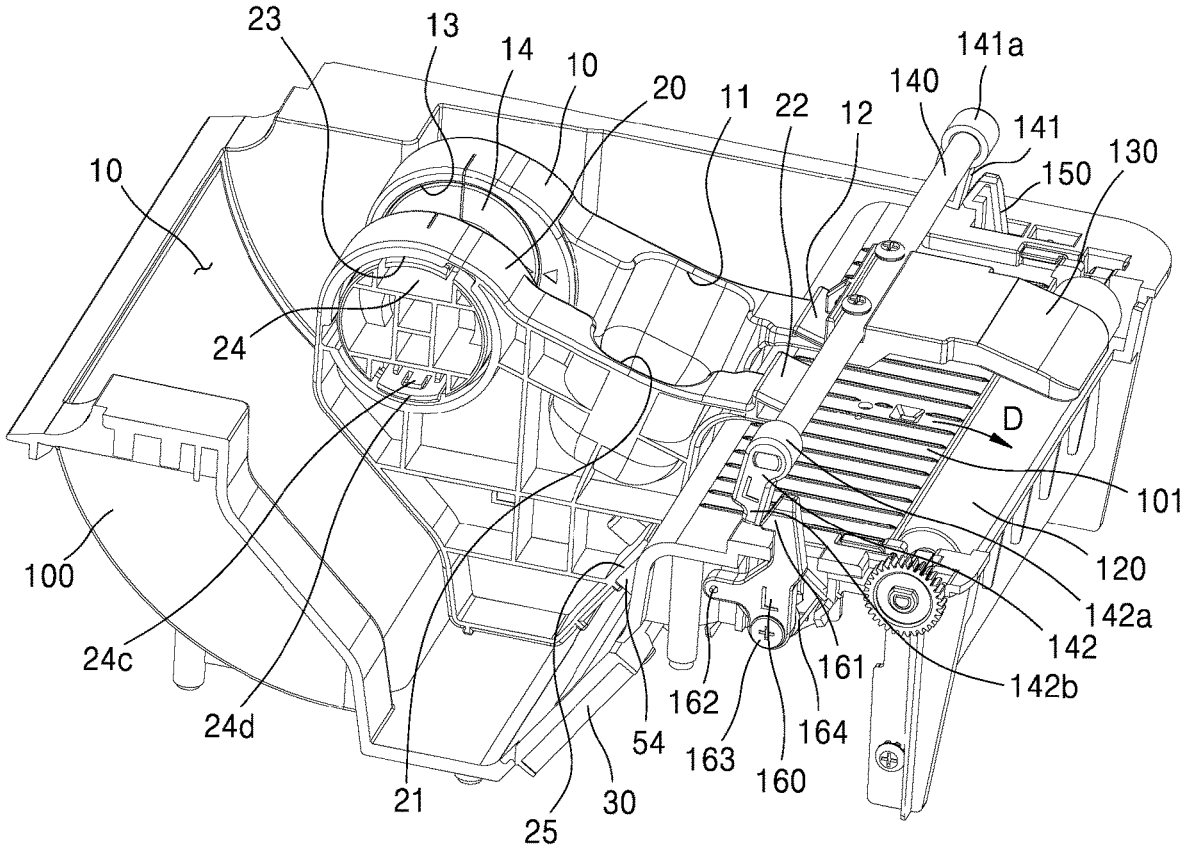

[Fig. 10]
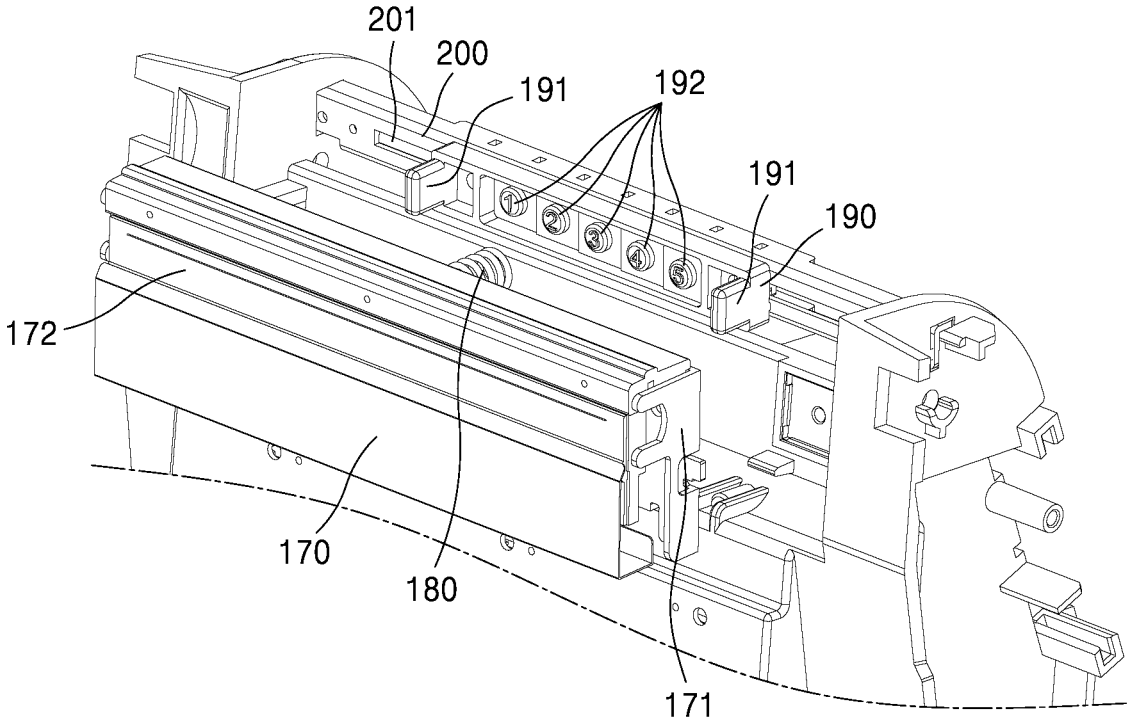

[Fig. 11]
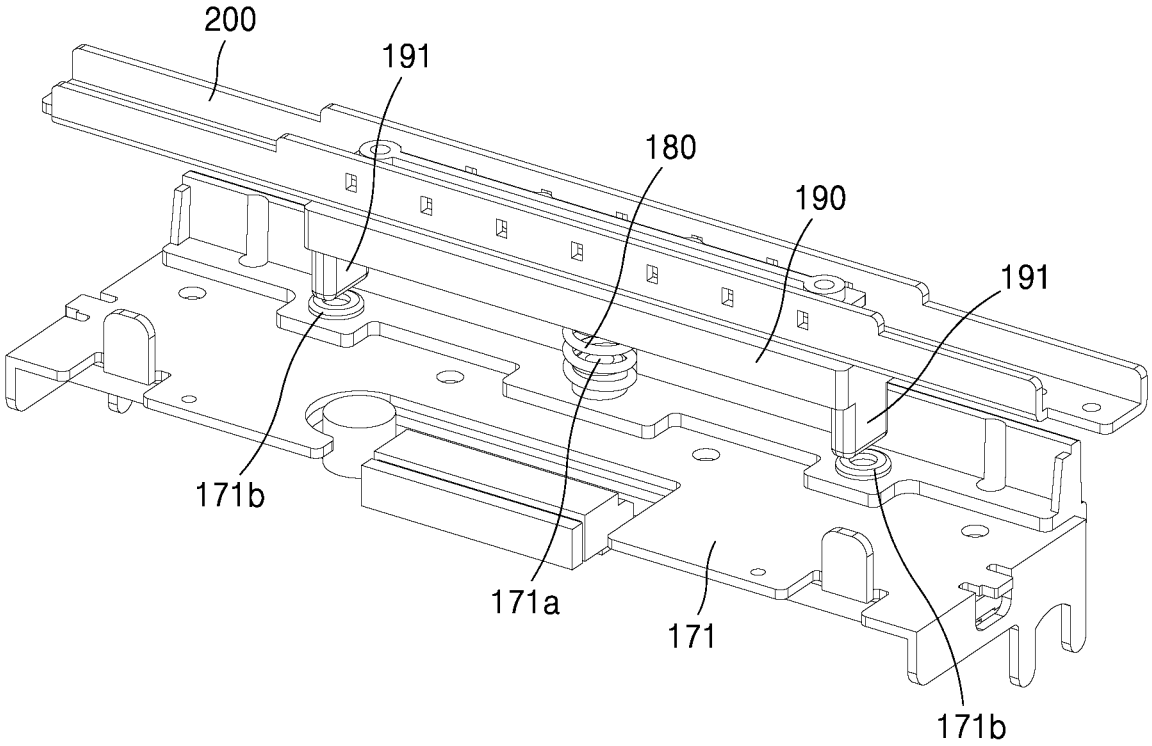

PAPER ROLL SUPPORT DEVICE FOR PRINTING APPARATUS

CROSS-REFERENCE TO RELATED APPLICATION

This application claims the benefit of Korean Patent Application No. 10-2020-0080309 filed on 2020 Jun. 30, which is hereby incorporated by reference herein in its entirety.

BACKGROUND

1. Technical Field

The embodiments disclosed herein relate to paper roll support devices that rotatably support a printing roll that is accommodated in a printing apparatus and feeds printing paper.

2. Description of the Related Art

Recently, small-sized printing apparatuses are used in various fields. Kiosks combined with small-sized printing apparatuses are widely used for the real-time printing of not only receipts and labels but also various tickets, vouchers, and number tags. Printing apparatuses installed in kiosks as described above generally employ a method of printing data while unwinding printing paper wound in the form of a roll.

Meanwhile, a paper roll is generally constructed in a form in which a cylindrical paper tube is provided and printing paper is wound around the outer circumference of the paper tube. Furthermore, the paper roll is rotatably fixed by a support device in a printing apparatus. In this state, when data is printed while the front end of the printing paper is transferred by a transfer means in the direction of a discharge exit, the paper roll is rotated and feeds the printing paper.

The paper roll support device is partially fitted into the hollow portion of the paper tube at both ends of the paper roll and supports the paper roll on both sides. For this purpose, the support device includes a pair of paper guides configured to support both ends of a paper roll.

In this case, the gap between the pair of paper guides must be adjusted to a gap corresponding to the height of a paper roll, i.e., the width of printing paper, and the portions of the paper guides that are fitted into the paper roll must have a width corresponding to the diameter of the paper tube of the paper roll, thereby securely fixing the paper roll without shaking.

Meanwhile, the width of required printing paper may vary depending on the environment in which a printing apparatus is used, and the diameter of the paper roll of a paper roll may vary depending on the specifications or manufacturer of printing paper.

Therefore, it is preferable that the gap between the paper guides and the width of the support portions fitted into a paper tube can be adjusted freely in accordance with the specifications of a paper roll in the printing paper support device of the printing apparatus.

For this purpose, a printing paper support device capable of adjusting paper guides has been used so far. Korean Utility Model Application Publication No. 20-1999-009348 discloses a roll paper support device in which a paper guide at one end of a paper tube is fixed and a paper guide at the other end of the paper tube is composed of an elastic member, thereby allowing the gap between the paper guides to be adjusted according to the height of a paper roll.

However, according to the support device, an elastic member providing elastic force in the longitudinal direction, such as a rubber belt or a coil spring having compression or tension, is employed, so that a problem arises in that it is difficult to expect high durability and a long life span for the support device. For example, when a large paper roll is fitted for a long time, the spring is plastically deformed in a compressed state. Thereafter, when a paper roll having a small width is used, the paper roll may not be sufficiently fixed by the support device. Therefore, there arises the inconvenience of replacing the support device or one or more parts.

Meanwhile, the above-described background technology corresponds to technical information that has been possessed by the present inventor in order to contrive the present invention or that has been acquired in the process of contriving the present invention, and can not necessarily be regarded as well-known technology that had been known to the public prior to the filing of the present invention.

SUMMARY

An object of embodiments disclosed herein is to provide paper roll support devices that have improved durability and an improved lifespan.

An object of embodiments disclosed herein is to provide paper roll support devices that have a compact and simple adjustment structure for paper guides.

An object of embodiments disclosed herein is to provide paper roll support devices that facilitate the manipulation of support portions that are fitted into the paper tube of a paper roll.

As a technical solution for accomplishing the above objects, according to an embodiment, there is provided a paper roll support device for a printing apparatus, the paper roll support device including: first and second paper guides arranged to be opposite to each other, and configured to support a paper roll, in which printing paper is wound, on both sides of the paper roll; a support panel configured to fix the first and second paper guides so that the first and second paper guides are movable in directions toward or away from each other; first and second transfer rods installed such that first ends thereof are fixed to the first and second paper guides, respectively, and configured to be movable in conjunction with each other in such a manner that opposite rack gears are disposed on the inner surfaces of the first and second transfer rods and engaged with one pinion gear; a pulley provided to be rotatable coaxially with the pinion gear; a belt adapted to extend a predetermined length and to be hung on the outer circumference of the pulley, installed such that one end thereof is fixed to one side of the outer circumference of the pulley and the other end thereof is fixed to one end of one of the first and second transfer rods, and configured to rotate the pulley; and an elastic member configured to reversely rotate the pulley to its original position by applying reverse rotational force to the pulley in a state in which the belt has rotated the pulley.

BRIEF DESCRIPTION OF THE DRAWINGS

The above and other objects, features, and advantages of the present invention will be more clearly understood from the following detailed description taken in conjunction with the accompanying drawings, in which:

FIG. 1 is a perspective view showing the configuration of a paper roll support device according to an embodiment;

FIG. 2 is a partially exploded perspective view showing the paper roll support device according to the embodiment with some components separated therefrom;

FIG. 3 is a view showing the operation of the paper roll support device according to the embodiment;

FIG. 4 is a perspective view showing a state in which the support column of a paper guide of the paper roll support device according to the embodiment is manipulated;

FIG. 5 is a partially exploded perspective view showing the paper guide of the paper roll support device according to the embodiment with the support column separated therefrom;

FIG. 6 is a plan view showing the paper guide of the paper roll support device according to the embodiment;

FIG. 7 is a perspective view showing the structure of the through hole of a paper guide of a paper roll support device according to another embodiment;

FIG. 8 is a perspective view showing the structure of the support column of the paper guide of the paper roll support device according to the other embodiment;

FIG. 9 is a perspective view showing the internal structure of a printing apparatus employing a paper roll support device according to an embodiment; and FIGS. 10 and 11 are perspective views showing a coupling structure for the print head of a printing apparatus according to an embodiment.

DETAILED DESCRIPTION

Various embodiments will be described in detail below with reference to the accompanying drawings. The following embodiments may be modified to various different forms and then practiced. In order to more clearly illustrate the features of the embodiments, detailed descriptions of items which are well known to those having ordinary skill in the art to the following embodiments pertain will be omitted. In the drawings, portions unrelated to the following description will be omitted. Throughout the specification, like reference symbols will be assigned to like portions.

Throughout the specification and the claims, when one component is described as being "connected" to another component, the one component may be "directly connected" to the other component or "electrically connected" to the other component through a third component. Furthermore, when any portion is described as including any component, this does not mean that the portion does not exclude another component but means that the portion may further include another component, unless explicitly described to the contrary.

Meanwhile, the same name may be assigned to a pair of components having corresponding structures and functions, and the pair of components may be referred to as the same name. However, one of the pair of components may not be illustrated in a drawing. In this case, one reference symbol may be assigned only to one component illustrated in the drawing. Furthermore, it will be understood that even when only one of the pair of components is illustrated in a drawing, the other one has a shape and function substantially corresponding to the component illustrated in the drawing.

The configurations of a paper roll support device 1000 according to an embodiment and a printing apparatus including the same will be described in detail below with reference to the accompanying drawings.

First, the specific configuration of the paper roll support device 1000 will be described with reference to FIGS. 1 to 8.

FIG. 1 is a perspective view showing the configuration of a paper roll support device according to an embodiment, FIG. 2 is a partially exploded perspective view showing the paper roll support device according to the embodiment with some components separated therefrom, and FIG. 3 is a view showing the operation of the paper roll support device according to the embodiment. Furthermore, FIG. 4 is a perspective view showing a state in which the support column of a paper guide of the paper roll support device according to the embodiment is manipulated, and FIG. 5 is a partially exploded perspective view showing the paper guide of the paper roll support device according to the embodiment with the support column separated therefrom. Furthermore, FIG. 6 is a plan view showing the paper guide of the paper roll support device according to the embodiment.

Furthermore, FIG. 7 is a perspective view showing the structure of the through hole of a paper guide of a paper roll support device according to another embodiment, and FIG. 8 is a perspective view showing the structure of the support column of the paper guide of the paper roll support device according to the other embodiment.

The paper roll support device 1000 according to the embodiment is provided in a printing apparatus, accommodates a paper roll in which printing paper is wound around a paper tube, and supports the paper tube at both ends of the paper tube so that the paper tube can be rotated, thereby allowing the paper roll to be rotated and feed the printing paper when the front end of the printing paper is subjected to the transfer force provided by a transfer roller (not shown).

For this purpose, the paper roll support device 1000 includes a pair of paper guides 10 and 20 configured such that the gap therebetween is adjusted according to the width of printing paper.

Meanwhile, the pair of paper guides 10 and 20 are arranged opposite to each other, and have shapes corresponding to each other. The pair of paper guides 10 and 20 may have a shape extending in the radial direction of the paper tube of a paper roll (not shown) to support both ends of the paper tube. More specifically, the paper guides 10 and 20 may have a bar shape that extends rearward from a support panel 30 to be described later. According to an embodiment, as shown in the drawings, they may have a trapezoidal or triangular body that also extends downward and is narrowed downward. In this case, the pair of paper guides 10 and 20 may be provided with grip portions 11 and 12 recessed into the opposite inner surfaces thereof in opposite directions away from each other. The grip portions 11 and 12 may be formed in such a manner that the opposite inner surfaces of the pair of paper guides 10 and 20 are recessed while forming smooth curved surfaces outward so that external force can be easily applied in the directions away from each other from the insides of the pair of paper guides 10 and 20.

Through this, a user may adjust the gap between the pair of paper guides 10 and 20 by pushing at least the grip portions 11 and 21 of the pair of paper guides 10 and 20 in open directions using fingers, e.g., thumbs.

Furthermore, guide portions 12 and 22 may be formed at the front ends of the pair of paper guides 10 and 20, respectively. The guide portions 12 and 22 are formed at the front ends of the paper guides 10 and 20, respectively, and guide both ends of the printing paper, unwound from a paper roll, forward. For this purpose, the guide portions 12 and 22 extend forward from the paper guides 10 and 20 as shown in the drawings, and extend a predetermined length up to the top surface of a paper support part 101 formed in an inner housing 100 to be described later.

In this case, the guide portions 12 and 22 may have a specific height to guide the printing paper from both ends forward.

Furthermore, the top surfaces of the guide portions 12 and 22 extend a predetermined length inward, i.e., toward each other, and form guide protrusions 12*a* and 22*a* in an inverted and reversed "L" shape and an inverted "L" shape, respectively. Accordingly, when the printing paper is transferred, it may be confined by the guide protrusions 12*a* and 22*a* so that the printing paper is not removed upward.

Meanwhile, through holes 13 and 23 and support columns 14 and 24 fitted into the through holes 13 and 23 are provided in the rear portions of the paper guides 10 and 20. The through holes 13 and 23 are formed through the paper guides 10 and 20 in the widthwise direction of the paper guides 10 and 20, and have a circular cross section. The support columns 14 and 24 are fitted into the through holes 13 and 23. Each of the support columns 14 and 24 includes a body portion 14*b* or 24*b* formed in a cylindrical shape having a height corresponding to the height of the through hole 13 or 23 and fitted and fixed into the through hole 13 or 23, and a support portion 14*a* or 24*a* formed to protrude in a cylindrical shape inward from the inner surface of the body portion 14*b* or 24*b* and to have a diameter smaller than the diameter of the cross section of the body portion 14*b* or 24*b* and an eccentric axis deviating from the central axis of the body portion 14*b* or 24*b*. In this case, the support portions 14*a* and 24*a* are inserted into a paper tube formed in the center of a paper roll and support the paper roll. In this case, the inner surfaces of the body portions 14*b* and 24*b* are used as the term that refers to the inner sides of the two bottom surfaces of the cylindrical body portions 14*b* and 24*b*, i.e., the bottom surfaces facing the opposite body portions 14*b* and 24*b*.

Meanwhile, in a state in which the support columns 14 and 24 have been partially inserted into the through holes 13 and 23, the support columns 14 and 24 are blocked from moving in an insertion direction, i.e., in the widthwise direction of the paper guides 10 and 20, in order not to be separated from the through holes 13 and 23, and the support columns 14 and 24 may move freely in a rotating direction. In contrast, in a state in which the support columns 14 and 24 have been completely inserted into the through holes 13 and 23, the support columns 14 and 24 are blocked from moving in an insertion direction and may also be blocked from moving in the rotation direction.

Hereinafter, the state in which the movement of the support columns 14 and 24 in the insertion direction is blocked and the movement of the support columns 14 and 24 in the rotation direction is free with the support columns 14 and 24 partially inserted into the through holes 13 and 23 will be referred to as a "preliminarily coupled state," and the state in which neither the movement of the support columns 14 and 24 in the insertion direction nor the movement of the support columns 14 and 24 in the rotation direction are blocked with the support columns 14 and 24 completely inserted into the through holes 13 and 23 will be referred to as a "coupled state."

In order to allow the support columns 14 and 24 to transition through the two different states, such as the "preliminarily coupled state" and then the "coupled state," in the through holes 13 and 23, as described above, catch protrusions 23*a* configured such that first and second stop protrusions 24*c* and 24*d* to be described later are selectively caught thereon may be formed on the inner circumferential surfaces of the through holes 13 and 23 at a specific height along the inner circumferential surfaces. In this case, the catch protrusions 23*a* may be formed to extend along the inner circumferential surfaces of the through holes 13 and 23 in inner circumferential directions. The catch protrusions 23*a* may be formed to uniformly protrude inward at a predetermined height, i.e., a specific height, in the insertion direction in which the support columns 14 and 24 are inserted into the through holes 13 and 23.

However, each of the catch protrusions 23*a* extending along the inner circumferences at a specific height is cut off by a length, corresponding to the width of third stop protrusions 24*e* to be described later, at a specific position, as shown in FIG. 5, thereby forming a protrusion seating portion 23*b* in which the third stop protrusion 24*e* is selectively seated. When the first stop protrusion 24*c* to be described later is caught on the catch protrusion 23*a*, the third stop protrusion 24*e* is seated in the protrusion seating portion 23*b*, thereby blocking the support column 14 or 24 from being rotated.

In other words, in a coupled state in which the first stop protrusion 24*c* is caught on the catch protrusion 23*a*, the protrusion seating portion 23*b* restrains both ends of the third stop protrusion 24*e*, thereby causing the support columns 14 and 24 to be fixed without rotation.

In this case, the protrusion seating portion 23*b* may be formed at a position that allows the third stop protrusion 24*e* to be seated in the protrusion seating portion 23*b* in a state in which the eccentric axis of the support portion 14*a* or 24*a* is selectively arranged in one of the positions closest to and farthest from a preset fixed position near the through hole 13 or 23.

Meanwhile, the catch protrusion 23*a* is formed to extend inward along the inner circumference, as described above, and may include a protrusion guide portion 23*c* tapered outward at a predetermined position, as shown in FIG. 5. The protrusion guide portion 23*c* may be formed in a partial section of the catch protrusion 23*a*. The protrusion guide portion 23*c* is formed in an outer stepped portion formed by the catch protrusion 23*a*, so that the first stop protrusion 24*c* to be described later may easily exit from a state of being caught on the catch protrusions 23*a*, i.e., a coupled state, and transition to a preliminarily coupled state or may easily transition from a preliminarily coupled state to a coupled state.

In this case, the width of the protrusion guide portion 23*c* may be formed to be larger than or equal to the width of the first stop protrusion 24*c* to be described later, and may be formed to be smaller than the width of the second stop protrusion 24*d*.

Meanwhile, the first stop protrusion 24*c* having a stepped portion along the outer circumference thereof at a predetermined height in the insertion direction may be formed along the outer circumferential surface of the body portion 14*b* or 24*b* of each of the support columns 14 and 24. In this case, the insertion direction refers to the height direction of the support column 14 or 24, i.e., the direction in which the support column 14 or 24 is inserted into or removed from the through hole 13 or 23, as indicated by the arrows in FIG. 5.

In this case, a step is formed at a predetermined height on the side surface of the body portion 14*b* or 24*b*, i.e., the outer circumferential surface of the body portion 14*b* or 24*b*, over an overall outer circumferential direction, so that the body portion 14*b* or 24*b* may be formed such that it has a larger diameter up to an inner predetermined height and has a smaller diameter on an outer side in the insertion direction in which the body portion 14*b* or 24*b* is inserted. Accordingly, when the body portion 14*b* or 24*b* of the support column 14 or 24 is inserted into the through hole 13 or 23, the overall body portion 14*b* or 24*b* in the insertion direction may be accommodated in the through hole 13 or 23. In other words, the outer side of the body portion 14*b* or 24*b* having a smaller diameter may be passed through the catch protrusions 23*a* and inserted into the outer side of the through hole 13 or 23 without interference with the catch protrusion 23*a* formed on the inner circumference of the through hole 13 or 23. For this purpose, the diameter of the outside of the body portion 14*b* or 24*b* may be smaller than the diameter of a transverse section formed by the inner circumferential surface of the catch protrusion 23*a*.

Accordingly, the step formed on the outer circumferential surface of the body portion 14*b* or 24*b* may be formed at a position corresponding to the position at which the catch protrusion 23*a* is formed. More specifically, the step formed on the outer circumferential surface of the body portion 14*b* or 24*b* may be formed at a position at which the step is engaged with the inner one of the two steps formed by the catch protrusion 13*a* or 23*a* protruding from the inner circumferential surface of the through hole 13 or 23. In this case, the inward directions refer to the directions in which the two paper guides 10 and 20 face each other, and the outward directions refer to the directions in which the two paper guides 10 and 20 are moved away from each other.

Meanwhile, the first stop protrusion 24*c* may be formed at a position at which the first stop protrusion 24*c* is caught on the outer one of the two steps formed by the catch protrusion 23*a* in a coupled state in which the support column 14 or 24 has been completely inserted into the through hole 13 or 23.

In this case, the first stop protrusion 24*c* may be formed in a cantilever structure in which the inner end thereof is connected to the body portion 14*b* or 24*b* in an integrated manner and the outer end thereof on which a protrusion is formed is formed as a free end. Accordingly, the outer end on which the protrusion is formed is formed is bent and moved around the inner end within a predetermined range, thereby being guided through being caught on the outer step of the catch protrusion 23*a* along the above-described protrusion guide portion 23*c*.

Meanwhile, the second stop protrusion 24*d* having a step along the outer circumference in the insertion direction may be formed at the outer end of the outer circumferential surface of the body portion 14*b* or 24*b* of each of the support columns 14 and 24.

The second stop protrusion 24*d* may be formed at an outer position compared to the first stop protrusion 24*c*, and may protrude a predetermined length along the outer circumference and be caught on the outer step formed by the above-described catch protrusion 23*a*. Since the second stop protrusion 24*d* is formed at the outer end of the body portion 14*b* or 24*b*, a part of the body portion 14*b* or 24*b* in the insertion direction may protrude from the through hole 13 or 23 to the outside in a state in which the second stop protrusion 24*d* is caught on the outer step of the catch protrusion 23*a*.

The state in which the second stop protrusion 24*d* is caught on the outer step of the catch protrusion 23*a* corresponds to the above-described preliminarily coupled state.

In this state, the second stop protrusion 24*d* is caught on the outer step of the catch protrusion 23*a* and the third stop protrusion 24*e* to be described later is caught on the inner step, and thus the movement of the support column 14 or 24 in the height directions with respect to the through hole 13 or 23 is blocked.

However, in the preliminarily coupled state, the movement of the support columns 14 and 24 in the rotation direction is not blocked. In the preliminarily coupled state, an end of the third stop protrusion 24*e* comes into contact with the inner step of the above-described catch protrusion 23*a* and both ends of the third stop protrusion 24*e* are not restrained, and thus the rotation of the support columns 14 and 24 is not blocked.

In this case, the second stop protrusion 24*d* may be also formed in a cantilever structure in which the inner end thereof is connected to the body portion 14*b* or 24*b* in an integrated manner and extends outward and the outer end thereof on which a protrusion is formed is formed as a free end, like the first stop protrusion 24*c*.

Meanwhile, the information that can be visually recognized by a user may be printed on the inner surfaces of the body portions 14*b* and 24*b* of the support columns 14 and 24 and the inner surfaces of the support portions 14*a* and 24*a*, or may be marked in an engraved or embossed manner. Furthermore, information may be printed near the through holes 13 and 23 of the paper guides 10 and 20, or may be marked in an engraved or embossed manner. Accordingly, a user may adjust the positions of the support portions 14*a* and 24*a* of the support columns 14 and 24 in accordance with the size of the paper tube of a paper roll that is inserted into the paper guides 10 and 20 based on the displayed information.

In this case, the information that is marked on the inner surfaces of the body portions 14*b* and 24*b* and the inner surfaces of the support portions 14*a* and 24*a* may include information about a numerical value, such as information about the diameter of a paper tube supported by the pair of support portions 14*a* and 24*a*, e.g., 1.0" or 1.5", as shown in FIG. 4. Furthermore, the arrangement positions of the support portions 14*a* and 24*a* at which paper tubes having marked diameters may be supported may be marked on the inner surfaces of the body portions 14*b* and 24*b* or near the through holes 13 and 23 by shapes such as lines, arrows, or the like.

Accordingly, in the temporary coupling state, a user may rotate the support columns 14 and 24 so that the arrows marked on the support columns 14 and 24 are arranged to face the arrows marked near the through holes 13 and 23 and then press the support columns 14 and 24, thereby fixing the support columns 14 and 24 in a coupled state.

For this purpose, the positions of the third stop protrusion 24*e* and the protrusion seating portion 23*b* may be set in advance such that the third stop protrusion 24*e* and the protrusion seating portion 23*b* are aligned with each other when the information marked near the through hole 13 or 23 and the information marked on the support column 14 or 24 are arranged at corresponding positions.

Accordingly, when the third stop protrusion 24*e* and the protrusion seating portion 23*b* are aligned with each other so that the third stop protrusion 24*e* can be inserted into the protrusion seating portion 23*b*, the support column 14 or 24 is additionally inserted into the through hole 13 or 23 by external force, so that the first stop protrusion 24*d* is moved over the catch protrusion 23*a* and caught on the outer step of the catch protrusion 23*a* and the third stop protrusion 24*e* is seated inside the protrusion seating portion 23*b*. As a result, the support column 14 or 24 may be fixed into the through hole 13 or 23 in a coupled state. In contrast, in a state in which the third stop protrusion 24*e* is not aligned with the protrusion seating portion 23*b* and comes into contact with the catch protrusion 23*a*, even when external force is applied, the support column 14 or 24 is not inserted into the through hole 13 or 23 and thus the preliminarily coupled state may be maintained.

When the position at which the information is marked near the through hole 13 or 23 as described above is expressed as a "fixed position," the protrusion seating portion 23*b* may be formed at a position that allows the third stop protrusion 24*e* to be seated in the protrusion seating portion 23*b* in a state in which the eccentric axis of the support portion 14*a* or 24*a* is selectively arranged at one of the positions closest to and farthest from the fixed position marked near the through hole 13 or 23. In this case, the fixed position refers to the position at which a straight line shape is marked in an engraved manner in FIG. 4.

Meanwhile, the support portions 14*a* and 24*a* have eccentric axes deviating from the central axis of the body portions 14*b* and 24*b* of the support columns 14 and 24, as described above. Accordingly, in the state in which the eccentric axes of the two support portions 14*a* and 24*a* are aligned with each other, the diameter of the paper tube of a paper roll that can be supported by the paper guides 10 and 20 corresponds to the diameter of the support portions 14*a* and 24*a*.

However, when the support portions 14*a* and 24*a* are in a coupled state in the state the eccentric axis of one of the two support portions 14*a* and 24*a*, e.g., the first support portion 14*a*, is arranged at the position closest to the fixed position and the eccentric axis of the other support portion, e.g., the second support portion 24*a*, is arranged at the position farthest from the fixed position, there may be fixed a paper tube having a diameter corresponding to the sum of the distance between the two eccentric axes of the two support portions 14*a* and 24*a* and the diameter of the support portions 14*a* and 24*a*.

The state shown in FIG. 6 is illustrated and described. When the fixed position is arranged on the left side based on FIG. 6 as an example, the first support column 14 is inserted into the first through hole 13 in a state in which the eccentric axis the first support portion 14*a* is arranged at the position closest to the fixed position and the second support column 24 is inserted into the second through hole 23 in a state in which the eccentric shaft of the second support part 24*a* is arranged at the position farthest from the fixed position.

In this state, the diameter L of the paper roll that may be supported by the pair of support columns 14 and 24 is the length obtained by adding the distance between the axes of the two support portions 14*a* and 24*a*, i.e., the distance between the eccentric axes of the first and second support portions 14*a* and 24*a*, to the diameter 1 of the support portions 14*a* and 24*a*. In this case, the "eccentric axes" of the support portions 14*a* and 24*a* are used as a term indicating the central axes of the support portions 14*a* and 24*a*, and the term is used to indicate that the support portions 14*a* and 24*a* are spaced apart by a predetermined distance from the central axis of the body portions 14*b* and 24*b*.

In this case, in the state shown in FIG. 6, the pair of support portions 14*a* and 24*a* are arranged such that the eccentric axis of the first support portion 14*a* is closest to the fixed position and the eccentric axis of the second support portion 24*a* is farthest from the fixed position, and thus the distance between the axes of the two support portions 14*a* and 24*a* may be twice the distance from the central axis of the body portions 14*d* and 24*d* to the eccentric axis of each of the support portions 14*a* and 24*a*, i.e., the eccentric distance.

Meanwhile, since the pair of support portions 14*a* and 24*a* are arranged to have relatively different distances from the fixed position, the diameter of the paper tube of a paper roll that can be fitted into the paper guides 10 and 20 may be varied.

Meanwhile, the structures of the through holes 13 and 23 and the support columns 14 and 24 formed in the paper guides 10 and 20 may be formed according to another embodiment. In this case, the prime symbol "'" is added to the reference symbols of components in order to distinguish the present embodiment from the previous embodiment. Furthermore, in the description of the present embodiment, although only one paper guide is illustrated and described in the drawings, it will be understood that the components described in the present embodiment are configured in pairs.

In the present embodiment, the state of the support column 24' may transition through a "preliminarily coupled state" in which movement in an insertion direction is blocked but movement in a rotation direction is free and a "coupled state" in which both movement in the insertion direction and movement in the rotation direction are blocked. However, in the present embodiment, the support column 24' maintains a state in which the body portion 24*b*' has been inserted into the through hole 23' over the overall insertion direction in both the preliminarily coupled state and the coupled state.

In greater detail, as shown in FIGS. 7 and 8, a catch protrusion 23*a*' may be formed on the inner circumference of the through hole 23'. The catch protrusion 23*a*' may be formed to extend along the inner circumferential surface of the through hole 23' in an inner circumferential direction in the same manner as the catch protrusion 23*a* according to the previous embodiment. In other words, the catch protrusion 23*a*' may be formed to uniformly protrude inward at a predetermined height, i.e., a specific height, in an insertion direction in which a support column 24' is inserted into the through hole 23'.

However, the catch protrusions 23*a*' formed at the specific height to extend along the inner circumference may be cut off over a predetermined section, as shown in FIG. 7.

A stop protrusion 24*d*' is caught on the catch protrusion 23*a*'. More specifically, the stop protrusion 24*d*' is caught on an outer step formed by the catch protrusions 23*a*', thereby causing the movement of the support column 24' in the insertion direction to be blocked.

Furthermore, a latch 23*d*' may be formed on the outer side of the through hole 23' in the insertion direction. The latch 3*d*' is formed to extend from the body of the paper guide 20', provided with the through hole 23', in an integrated manner, and may have a cantilever shape in which the latch 3*d*' extends from the inner circumference of the through hole 23' to an outer side in the insertion direction and the outer end of the latch 3*d*' is vertically bent toward the central axis of the through hole 23'. In this case, the width of the front of the outer end of the latch 23*d*' is increased and thus formed in a plate shape in the form of approximately the alphabet capital letter "T." The outer end of the latch 23*d*' may receive external force from a user, and may have a shape having an increasing width so that the user can easily manipulate the latch 23*d*'.

In this case, the overall body of the paper guide 20' may be made of synthetic resin, and the latch 23*d*' formed in an integrated manner is also made of synthetic resin. The latch 23*d*' may be configured to be bent outward thanks to the elasticity of the synthetic resin when receiving external force.

Furthermore, a protruding portion 23*e*' extending toward the inside of the through hole 23' may be formed on the bent portion of the latch 23*d*' that is bent outward. The protruding portion 23$e'$ may extend from the bent portion of the latch 23$d'$ by a predetermined length in the insertion direction on the inner circumference of the through hole 23'. In this case, the width of the protruding portion 23$e'$ may correspond to the width of the groove 24$g'$, and thus the protruding portion 23$e'$ may be fitted into the groove 24$g'$ and both ends may be restrained.

Furthermore, the latch 23$d'$ may come into contact with the outer ends of bumps 24$f'$ to be described later and prevent the support column 24' from being separated outward.

Meanwhile, a stop protrusion 24$d'$ may be formed on the support column 24', as shown in FIG. 8. When the support column 24' is inserted into the through hole 23', the stop protrusion 24$d'$ is moved over the catch protrusion 23$a'$ formed on the inner circumference of the through hole 23' and caught on the outer step of the catch protrusion 23$a'$, thereby blocking movement in the insertion direction in order to prevent the support column 24' from being separated from the through hole 23'.

Furthermore, as shown in FIG. 8, the body portion 24$b'$ of the support column 24' may be formed in a hollow cylindrical shape in which the bottom surface thereof, i.e., the inner surface thereof, on which a support portion (not shown) is formed, is closed and the outer surface thereof is open. When viewed from the open outer side, the pair of bumps 24$f'$ may protrude from the inner circumferential surface of the support column 24' and extend in parallel to the insertion direction of the support column 24'. In this case, the bumps 24$f'$ may extend over the overall insertion direction of the support column 24', as shown in the drawing. Alternatively, the bumps 24$f'$ may extend over at least a part of the insertion direction of the support column 24', in which case they may be formed in a portion near the outer end. Accordingly, the outer ends of the bump 24$f'$ may come into contact with the latch 23$d'$ formed on the outer side of the through hole in the insertion direction.

Meanwhile, the pair of bumps 24$f'$ protrude in parallel with each other, thereby forming a long and narrow groove 24$g'$ therebetween. Accordingly, the groove 24$g'$ may be formed in a groove shape having a width corresponding to the gap between the pair of bumps 24$f'$.

In this case, the width of the groove 24$g'$ may correspond to the width of the protruding portion 23$e'$ described above. Accordingly, in the state in which the support column 24' has been inserted into the through hole 23', when the groove 24$g'$ is rotated to a position corresponding to the protrusion 23$e'$ formed on the bent portion of the latch 23$d'$, the protruding portion 23$e'$ may be fitted into the groove 24$g'$. When the protruding portion 23$e'$ is fitted into the groove 24$g'$, both ends of the protruding portion 23$e'$ are restrained by the pair of bumps 24$f'$, thereby blocking the movement of the support column 24' in the rotation direction.

In this case, as still another embodiment, there may be implemented a structure in which a groove is formed on the bent portion of the latch 23$d'$, a protruding portion corresponding to the groove is provided on the inner circumferential surface of the support column 24', and movement in the rotation direction is blocked in such a manner that the protruding portion is fitted into the groove.

In the present embodiment, through the above-described configuration, the support column 24' may be coupled into the through hole 23' in a "coupled state" in which both movement in the rotation direction and movement in the insertion direction are all blocked, like in the previous embodiment described with reference to FIGS. 4 to 6. In this coupled state, the support column 24' is inserted into the through hole 23', so that the stop protrusion 24$d'$ of the support column 24' is moved over the catch protrusions 23$a'$ and caught on the outer end of the catch protrusions 23$a'$ and the protruding portion 23$e'$ is inserted into the groove 24$g'$ formed on the inner circumferential surface of the support column 24'.

Meanwhile, in the present embodiment, the support column 24' may be in a "preliminarily coupled state" in which movement in the rotation direction is free and only movement in the insertion direction is blocked. In this preliminarily coupled state, the protruding portion 23$e'$ is not fitted into the groove 24$g'$. In other words, when the latch 23$d'$ is deformed outward in the insertion direction by external force and the protruding portion 23$e'$ is separated from the groove 24$g'$, the support column 24' may be in a state in which rotation is not blocked. In this preliminarily coupled state, the support column 24' may be freely rotated. Thereafter, when the external force is removed, the support column 24' is rotated and the groove 24$g'$ is moved to a position corresponding to the protruding portion 23$e'$, the protruding portion 23$e'$ may be inserted into the groove 24$g'$ and the support column 24' may be in a coupled state again.

In this case, the groove 24$g'$ may include two or more grooves 24$g'$ formed at two or more different positions, in which case the protruding portion 23$e'$ may be selectively caught on the two or more grooves 24$g'$. For example, two grooves 24$g'$ may be formed at opposite positions, as shown in the drawing, and accordingly, the protruding portion 23$e'$ may fix the support column 24' so that the support column 24' is in a coupled state at the two different positions.

In particular, the grooves 24$g'$ may be formed at positions that allow the above-described protruding portion 23$e'$ to be fitted into one of the grooves 24$g'$ in a state in which the eccentric axis of the support portion 24$a'$ has been selectively arranged at one of the positions closest to and farthest from a preset fixed position around the through hole 23'. In this case, the fixed position does not necessarily need to be marked such that a user can recognize it, as described above.

In this way, in the present embodiment, the eccentric axes of support portions 24$a'$ may be arranged at different positions by the rotation of the support columns 24', so that the diameter of a paper roll that can be supported by the pair of support columns 24' may be varied as needed.

Meanwhile, referring back to FIGS. 1 to 3, coupling portions 25 fixedly coupled to the connection portions 44 and 54 of the pair of transfer rods 40 that are movably installed on the support panel 30 to be described later may be formed at the respective rear ends of the pair of paper guides 10 and 20 in contact with the support panel 30.

In this case, the coupling portions 25 formed in the respective paper guides 10 and 20 may be formed in shapes corresponding to the shapes of the connection portions 44 and 54 extending rearward from the bodies of the transfer rods 40 and 50, and the coupling portions 25 and the connection portions 44 and 54 may be tightly into each other. Alternatively, an adhesive may be applied between the connecting portions 44 and 54 and the coupling portions 25, or a fastening means for securely fixing the connecting portions 44 and 54 and the coupling portion 25 to each other, e.g., bolts or the like, may be employed.

Furthermore, the pair of paper guides 10 and 20 may be supported by the support panel 30 to be movable in directions toward or away from each other. In this case, the support panel 30 is a substantially rectangular plate-shaped panel, and is arranged perpendicular to the direction in which the paper guides 10 and 20 extend.

The support panel 30 sufficiently extends over the movement range of the pair of paper guides 10 and 20 and has a predetermined height and thickness so that it can guide and support the movement of the paper guides 10 and 20 behind the paper guides 10 and 20.

Furthermore, first and second guide slots 31 and 32 that are formed through the movement paths of the first and second paper guides 10 and 20, guide the first and second paper guides 10 and 20 through their movement, and allow the pair of paper guides 10 and 20 to be coupled to the pair of transfer rods 40 and 50 to be described later, respectively, through the support panel 30 are formed in the support panel 30.

The pair of guide slots 31 and 32 are formed through the support panel 30 while having substantially rectangular cross sections. The first guide slot 31 is formed on the movement path of the first paper guide 10, and the second guide slot 32 is formed on the movement path of the second paper guide 20.

Accordingly, the coupling portions 25 of the pair of paper guides 10 and 20 disposed in front of the support panel and the connection portions 44 and 54 formed on the pair of transfer rods 40 and 50 disposed behind the support panel 30 may be coupled to each other through the guide slots 31 and 32 formed through the support panel 30, and may reciprocate along the guide slots 31 and 32 in a coupled state while being supported by the support panel 30.

The first and second guide slots 31 and 32 may be arranged alongside each other to be symmetrical on both sides of the center of the support panel 30 in the longitudinal direction.

Meanwhile, a cylindrical rotating shaft 33 may be formed to extend between the first and second guide slots 31 and 32 rearward from the center of the support panel 30 in the longitudinal direction. The rotating shaft 33 may be molded together with the support panel 30 in an integrated manner, or may be vertically fixed to the rear surface of the support panel 30.

A pinion gear 60 and a pulley 70 to be described later may be rotatably fitted over the outer circumference of the rotating shaft 33.

Furthermore, transfer rails 34 and 35 configured such that the pair of transfer rods 40 and 50 to be described later are inserted thereinto are formed to extend above or below the pair of guide slots 31 and 32, formed alongside each other, in the rear surface of the support panel 30. The transfer rails 34 and 35 may be formed to protrude at a predetermined height from the rear surface of the support panel, and may be arranged parallel to each other in the longitudinal direction.

One of the first and second transfer rails 34 and 35 may be arranged above the first and second guide slots 31 and 32 in parallel with the longitudinal direction of the first and second guide slots 31 and 32. The other one of the first and second transfer rails 34 and 35 may be arranged below the first and second guide slots 31 and 32 in parallel with the longitudinal direction of the first and second guide slots 31 and 32.

The transfer rails 34 and 35 may be formed to protrude rearward from the rear surface of the support panel 30 to have substantially rectangular cross-sectional shapes, as shown in the drawing. According to an embodiment, they may be molded together with the support panel 30 in an integrated manner.

The transfer rails 34 and 35 may extend long along the longitudinal direction of the support panel 30, and the transfer rods 40 and 50 are fitted into the transfer rails 34 and 35 so as to reciprocate along the transfer rails 34 and 35.

Meanwhile, an extension panel 36 formed to extend rearward from the support panel 30 in an integrated manner may be provided on the rear surface of the support panel 30. The extension panel 36 may be formed in a substantially plate shape, and may thus provide support force when the support panel 30 is coupled to another component in the printing apparatus, e.g., the inner housing 100 or the like.

Furthermore, a hook 36' is provided on one side of the extension panel 36, and allows an elastic member 90, to be described later, to be caught thereon.

Meanwhile, each of the transfer rods 40 and 50 may include a head portion 41 or 51, and a tail portion 42 or 52 extending from the head portion 41 or 51. In this case, the head portion 41 or 51 is provided with the connection portion 44 or 54 that is coupled to the above-described coupling portion 25 of the paper guide 10 or 20 through the guide slot 31 or 32. The connection portion 44 or 54 passes through the guide slot 31 or 32, extends toward the paper guide 10 or 20, and forms a connecting portion with the coupling portion 25.

Furthermore, the tail portion 42 or 52 extends inward from the head portion 41 or 51 along the transfer rail 34 or 35.

More specifically, based on FIGS. 1 and 2, the head portion 41 of the first transfer rod 40 is disposed on the right side of the drawing, on which the first guide slot 31 is formed, around the rotating shaft 33, and the tail portion 42 of the first transfer rod 40 extends from the head portion 41 to the left along the first transfer rail 34. Meanwhile, the head portion 51 of the second transfer rod 50 is disposed on the left side of the drawing, on which the second guide slot 32 is formed, around the rotating shaft 33, and the tail portion 52 of the second transfer rod 50 may extend from the head portion 42 to the right along the second transfer rail 35.

In this case, rack gears 43 and 53 configured to engage with the one pinion gear 60 may be formed on the opposite inner surfaces of the tail portions 42 and 52, respectively.

Accordingly, when any one of the pair of transfer rods 40 and 50, e.g., the first transfer rod 40, moves, the pinion gear 60 engaged with the rack gear 43 is rotated as the rack gear 43 formed on the tail portion 42 of the first transfer rod 40 is rotated. Therefore, the rotational force of the pinion gear 60 is transmitted to the rack gear 53 of the tail portion 52 of the second transfer rod 50 engaged with the pinion gear 60, so that the second transfer rod 50 is also moved.

In this case, the rack gears 43 and 53 are formed on the opposite inner surfaces of the tail portions 42 and 52 of the transfer rods 40 and 50 and are engaged with the one pinion gear 60 in parallel to each other, e.g., in opposite tangent directions. Accordingly, the pinion gear 60 transmits the power, generated by the movement of one of the transfer rods 40 and 50, to the opposite transfer rod in the opposite direction. Therefore, when one of the transfer rods 40 and 50 moves to the right, the other transfer rod is moved to the left. In other words, when one of the transfer rods 40 and 5 moves in a direction toward the other transfer rod, the other transfer rod is also moved in a direction toward the one transfer rod. In contrast, when one of the transfer rods 40 and 5 moves in a direction away from the other transfer rod, the other transfer rod is moved in a direction away from the one transfer rod.

For example, when the first transfer rod 40 moves to the right based on FIG. 1 or 2, the pinion gear 60 is moved in the clockwise direction and applies force to the second transfer rod 50 in the left direction.

As described above, the two transfer rods 40 and 50 are moved in conjunction with each other, but the moving directions may always be opposite to each other.

Meanwhile, one or more of the transfer rods 40 and 50 may be provided with belt coupling portions 45 and 55. Each of the belt coupling portions 45 and 55 is a substantially cylindrical protrusion formed by extending rearward from the head portion 41 or 51 of the transfer rod 40 or 50. Any one of both ends of a belt 80, to be described later, in the longitudinal direction is fitted onto the outer circumference of the belt coupling portion 45 or 55, and threads are formed on the inner circumference of the belt coupling portion 45 or 55. The belt coupling portion 45 or 55 and the belt 80 may be fixed with a screw.

Meanwhile, the pinion gear 60 may be rotatably coupled to the outer circumference of the rotating shaft 33 extending between the first and second guide slots 31 and 32 from the rear surface of the support panel 30. In this case, the pinion gear 60 has an approximately ring shape. The inner circumference of the pinion gear 60 has a diameter equal to or larger than the diameter of the rotating shaft 33 and is rotatably coupled to the rotating shaft 33, and teeth having a pitch corresponding to the pitch of the rack gears 43 and 53 are formed on the outer circumference of the pinion gear 60.

Meanwhile, according to an embodiment, the paper roll support device 1000 includes a pulley 70 provided to be rotatable coaxially with the pinion gear 60.

The pulley 70 has a disk shape as a whole. The pulley 70 is rotatably fixed to the rear surface of the support panel 30, and is rotated by the elastic force of the elastic member 90 to be described later, thereby allowing the belt 80, to be described later, to be wound.

An outer circumferential rail 71 configured such that the belt 80 is selectively wound thereon is formed along the outer circumference of the pulley 70. The outer circumferential rail 71 may have a structure in which the front and rear ends of the outer circumference in the height direction extend radially along the outer circumference so that the belt 80 is not removed from the outer circumferential rail 71.

Meanwhile, a through column 72 configured to be fitted over the rotating shaft 33 is disposed in the center of the pulley 70. The through column 72 is passed through the pulley 70 in the height direction of the pulley 70, i.e., the direction in which the pulley 70 is inserted over the rotating shaft 33, while forming a circular cross section. The periphery of the through hole may be formed to extend rearward from the rear surface of the pulley 70 and may thus have a hollow column shape as a whole.

Accordingly, an elastic member 90 to be described later is fitted over the outer circumference of the through column 72.

In this case, the through column 72 may have a height larger than or equal to the height of the elastic member 90 fitted over the through column 72. The height of the rotating shaft 33 over which both the pinion gear 60 and the through pillar 72 are fitted may be larger than the sum of the height of the pinion gear 60 and the height of the through column 72.

Furthermore, a hook 73 may be formed on one side of the rear surface of the pulley 70. In this case, the hook 73 is formed to protrude rearward from the rear surface of the pulley 70, and has an approximately hook shape so that an end of the elastic member 80 to be described later may be caught thereon so as not to be separated. The hook 73 may be located on the rear surface of the pulley 70 while being spaced apart from the through column 72 by a predetermined distance and being close to the outer circumference of the pulley 70.

Meanwhile, a belt fixing portion 74 may be provided on one side of the pulley 70. The belt fixing portion 74 fixes one of both ends of the belt 80, to be described later, in the longitudinal direction. For this purpose, the belt fixing portion 74 may have a shape corresponding to the structure of one of both ends of the belt 80 in the longitudinal direction, and may be provided with a threaded hole, into which a fastening means such as a screw is inserted, on one side thereof.

Although the belt fixing portion 74 may be formed at a different position according to an embodiment, it may be formed on the rear surface of the pulley 70, as shown in the drawing.

Meanwhile, the paper roll support device 1000 according to an embodiment includes a belt 80. The belt 80 extends a predetermined length. The belt 80 is wound on the outer circumferential rail 71 of the pulley 70 with one end 81 thereof in the longitudinal connected to one side of the outer circumference of the pulley 70 and the other end 82 thereof fixed to one end of one of the first and second transfer rods 40 and 50, and rotates the pulley 70.

In other words, when the transfer rods 40 and 50 move in the state in which the other end 82 of the belt 80 has been fixed to any one of the transfer rods 40 and 50, the belt 80 is pulled, and thus, the pulley 70 is rotated.

In this case, both ends of the belt 80 in the longitudinal direction are coupled to the belt fixing portion 74 formed on the rear surface of the pulley 70 and the belt coupling portion 45 or 55 formed on the head portion 41 or 51 of the transfer rod 40 or 50. For this purpose, the one end 81 of the belt 80 has a shape corresponding to that of the belt fixing part 74 so that it can be screwed in the state of being fitted into the belt fixing part 74, and the other end 82 of the belt 80 has a shape corresponding to that of the belt coupling portion 45 or 55 so that it can be screwed in the state of being fitted to the belt coupling portion 45 or 55.

Meanwhile, the paper roll support device 1000 is provided with an elastic member 90 configured to reversely rotate the pulley 70 to its original position by applying rotational force to the pulley 70 in the reverse direction in the state in which the pulley 70 has been rotated by the belt 80. The elastic member 90 is configured to apply torsional force in the rotational direction of the pulley 70 through the elastic deformation thereof.

In this case, the original position of the pulley 70 refers to a state in which the two paper guides 10 and 20 are brought close to each other, i.e., a state in which the two transfer rods 40 and 50 are arranged close to each other around the rotating shaft 33 so that the belt 80 is wound around the pulley 70. For example, the original position of the pulley 70 is the position shown in FIG. 1.

Furthermore, the state in which the pulley 70 has been rotated refers to a state in which the tension of the belt 80 has been applied and has rotated the pulley 70 because the two transfer rods 40 and 50 have been moved in a direction away from each other, so that the belt coupling portions 45 and 55 formed on the transfer rods 40 and 50 have been moved away from each other, with the result that the other end 82 of the belt 80 has been pulled and unwound from the pulley 70. For example, this state is the state shown in FIG. 3.

The elastic member 90 may be fitted over the through column 72, formed in the center of the pulley 70, coaxially with the pulley 70. Furthermore, one end 91 of the elastic member 90 is fixed to the outside of the pulley 70, and the other end 92 of the elastic member 90 is fixed to one side of the support panel 30. Accordingly, when external force is removed, the elastic member 90 returns the pulley 70 to its original position by applying elastic force to the pulley 70 in the rotational direction. In other words, when the pulley 70 is rotated, the hook 73 formed on the outer circumferential side of the rear surface of the pulley 70 is moved by the rotation of the pulley 70, so that one end 91 of the elastic member 90 is moved in the rotational direction with respect to the other end 92 fixed to the support panel 30, and the elastic member 90 is elastically deformed. Accordingly, the elastic member 90 provides elastic force in the direction opposite to the direction in which the pulley 70 has been rotated. Therefore, when the external force is removed, the pulley 70 may be reversely rotated to its original position by the elastic force.

This elastic member 90 may include a torsion spring. Meanwhile, in the present specification, the term "torsion spring" refers to a torsional coil spring in which supports are formed at both ends of a coil spring and thus torsional force can be applied.

Meanwhile, in a state in which both ends of the elastic member 90 have been hung on the hook 73 protruding at a position on the rear surface of the pulley 70 spaced apart from the rotating axis of the pulley 70 by a predetermined distance in the radial direction and the hook 36' formed at the rear end of the extension panel 36 extending rearward from the rear surface of the support panel 36, respectively, only the one end 91 is selectively moved by the rotation of the pulley 70, so that the relative angle of the two supports of the elastic member 90 is changed, with the result that torsional force is applied to the pulley 70.

Furthermore, according to an embodiment, as shown in FIG. 2, in the state in which the pinion gear 60, the pulley 70, and the elastic member 90 have been sequentially fitted over the rotating shaft 33, the individual components are fastened by a finishing member in order to prevent them from being separated from the rotating shaft 33.

Meanwhile, as shown in FIG. 3, the paper guides 10 and 20 of the paper roll support device 1000 may be moved in a direction away from each other by external force, e.g., the force applied to the outside in the state in which the gripping parts 11 and 21 have been gripped by the hands of a user.

Accordingly, when one of the paper guides 10 and 20 to which external force is applied, e.g., the second paper guide 20, is moved outward, the second transfer rod 50 coupled to the second paper guide 20 is moved outward, i.e., to the left of the drawing. Therefore, the pinion gear 60 engaged with the rack gear 53 formed on the second transfer rod 50 is rotated and the rotation of the pinion gear 60 is applied to the rack gear 43, so that the first transfer rod 40 is moved outward, i.e., to the right of the drawing.

Accordingly, when the transfer rods 40 and 50 are moved in the direction away from each other, the belt 80 the other end 82 of which is fixed to the belt coupling portion 45 formed on the head portion 41 of the first transfer rod 40 is pulled to the right, the tension of the belt 80 is transmitted, and the one end 81 of the belt 80 is also moved along with the other end 82 of the belt 80. Therefore, the pulley 70 to which the one end 81 of the belt 80 is fixed is rotated, e.g., in a clockwise direction.

In this case, as the one end 91 of the elastic member 90, which is hung on the hook 73, is moved by the rotation of the pulley 70, the elastic member 90 is elastically deformed, and thus, torsional force is accumulated.

Accordingly, when the external force applied to the grip portion 21 is removed, the pulley 70 is reversely rotated to its original position by the elastic force of the elastic member 90, the belt 80 is rewound around the pulley 70, and the transfer rods 40 and 50 are also returned toward the rotating shaft 33. Accordingly, the two paper guides 10 and are also moved in a direction toward each other. As a result, a paper roll inserted between the paper guides 10 and may be securely fastened.

Therefore, when fitting a paper roll into the paper guides 10 and 20, a user applies force to the grip portions 11 and 21 so that the two paper guides 10 and 20 are moved in a direction away from each other. Furthermore, a paper roll may be inserted between the opened paper guides 10 and 20. Accordingly, as the transfer rods 40 and 50 are moved outward, the belt 80 is unwound from the pulley 70 and rotates the pulley 70, and the elastic member 90 is elastically deformed by the rotation of the pulley 70. Thereafter, when the user removes the external force applied to the grip portions 11 and 21, the elastic member 90 reversely rotates the pulley 70, so that the belt 80 is wound around the pulley 70. As a result, the transfer rods 40 and 50 and the two paper guides 10 and 20 are subjected to the force intended for inward movement back, and thus support the paper roll accommodated therebetween.

An additional configuration of a printing apparatus including the above-described paper roll support device 1000 will be described below with reference to FIGS. 9 to 11.

FIG. 9 is a perspective view showing the internal structure of a printing apparatus employing a paper roll support device according to an embodiment, and FIGS. 10 and 11 are perspective views showing a coupling structure for the print head of a printing apparatus according to an embodiment.

Referring to FIG. 9, an inner housing 100 may be configured inside the printing apparatus.

The paper roll support device 1000 may include a body (not shown) and a cover (not shown) that are hinged to each other. The appearances of the body and the cover may be finished with a body housing (not shown) and a cover housing (not shown), respectively. In the inner space surrounded by the body housing and the cover housing, various components required to print information on printing paper wound on a paper roll may be accommodated. In particular, a space in which a paper roll is accommodated, i.e., a paper accommodation portion 110 to be described later, is formed between the body housing and the cover housing. For this purpose, in the body housing is provided the inner housing 100 that separates the paper accommodation portion 110 from a space in which other components are accommodated by partitioning a space formed inside the body and neatly finishes the configuration exposed to a user by opening the cover.

As shown in FIG. 9, the inner housing 100 provides a space for the movement of the paper guides 10 and 20 inside, and has a substantially semi-cylindrical shape surrounding the paper accommodation portion 110 in order to accommodate a paper roll inserted between the paper guides 10 and 20. Furthermore, the outer side of the inner housing 100 may be fitted and fixed to the inner side of the body housing.

The inner housing 100 is arranged between the body housing and the cover housing, finishes the inner space so that some components, such as a substrate or an electric wire, are not exposed to the outside even when the cover housing is opened, and allows the paper accommodation portion 110 and the paper guides 10 and 20 to be selectively exposed such that a user can replenish or replace a paper roll.

Meanwhile, in the inner housing 100, the support panel 30 is fitted behind the paper guides 10 and 20, and the front side of the support panel 30 forms one surface along with the inner housing 100, thereby forming the inner surface of the paper accommodation portion 110. For this purpose, an opening corresponding to the support panel 30 may be provided in the inner housing 100 so that the support panel 30 can be fitted without forming a step. Accordingly, the components, including the transfer rods 40 and 50, the pinion gear 60, the pulley 70, the belt 80, and the elastic member 90, provided on the rear surface of the support panel 30 are finished with the inner housing 100 and the cover, and may thus be accommodated so as not to be exposed to the outside even when the cover is opened.

Meanwhile, a plate-shaped paper support portion 101 extending substantially horizontally under the guide portions 12 and 22 of the above-described paper guides 10 and 20 may be provided behind the inner housing 100. The paper support part 101 is integrated with the inner housing 100, extends from the rear ends of the paper guides 10 and 20 to a paper outlet (not shown) formed at the rear end of the inner housing 100, and supports printing paper beneath the printing paper.

This paper support portion 101 has a width equal to or larger than the width of printing paper, extends along the direction in which printing paper is transferred, and has a substantially rectangular plate shape. In this case, protrusions extending in the direction in which printing paper is transferred may be formed on the top surface of the paper support portion 101 at predetermined intervals.

Meanwhile, as described above, the paper accommodation portion 110 is formed as an empty space between the inner housing 110 and the cover housing. In this case, the paper accommodation portion 110 is a space formed through the cooperation between the inner housing and the cover housing, which are not shown in the drawings.

The paper guides 10 and 20 are provided to reciprocate in the paper accommodation portion 110, and an approximately semi-cylindrical space is formed such that that a paper roll inserted between the paper guides 10 and 20 can be accommodated therein.

Meanwhile, a roller 120 may be arranged behind the paper support portion 101. The roller 120 extends perpendicular to the direction in which printing paper is transferred and rotates, thereby providing transfer force so that the printing paper wound on a paper roll is transferred toward a discharge exit.

Furthermore, a print head 170 to be described later may be disposed above the roller 120. In this case, the print head 170 may be fixed to the cover so that the bottom surface of the print head 170 is exposed downward. Accordingly, the roller 120 rotates while pressing printing paper toward the exposed bottom surface of the print head 170 so that the printing paper is transferred backward while information is printed on the printing paper.

Meanwhile, although the roller 120 is shown as being provided on the body and the print head 170 is shown as being provided on the cover in the embodiment shown in the drawing, the present invention is not necessarily limited to this embodiment. According to an embodiment, the roller 120 may be provided on the cover side, and the print head 170 may be provided on the body side.

Furthermore, the paper roll support device 1000 according to an embodiment is provided with a lever 130 that is disposed above the paper support portion 101 and extends rearward. The lever 130 is provided in the cover, and the rear end of the lever 130 may be exposed out of the cover. Accordingly, a user may apply external force, e.g., by lifting or pressing the rear end of the lever 130.

Furthermore, the front end of the lever 130 may be fixed perpendicular to a shaft 140 to be described later. Accordingly, when external force is applied to the rear end of the lever 130 in the vertical direction, the lever 130 may rotate the shaft 140.

In this case, the shaft 140 may be accommodated inside the cover housing, and both ends of the shaft 140 may be rotatably fixed to the cover housing. For example, both ends of the shaft 140 may be fitted into rotation shafts provided in the cover housing and then rotated.

Further, push rods 141 and 142 may be coupled to both ends of the shaft 140, respectively. The push rods 141 and 142 have a predetermined length. A coupling head 141*a* or 142*a* coupled to an end of the shaft 140 is disposed at one end of each of the push rods in the longitudinal direction, and a push portion 142*b* configured to push and move the locking portion 151 or 161 of a locking member 150 or 160, to be described later, rearward is disposed at the other end of the push rod in the longitudinal direction.

Therefore, when the shaft 140 is rotated by the external force applied to the lever 130, the push portions 141*b* and 142*b* of the push rods 141 and 142 may be moved. When a user lifts the rear end of the lever 130, the shaft 140 is rotated counterclockwise based on the direction shown in FIG. 9, and accordingly, the push portions 141*b* and 142*b* may be all moved rearward within a predetermined range.

Meanwhile, as shown in FIG. 9, the locking members 150 and 160 configured to extend upward from the lower portions of the inner housing 110 and to be partially exposed are provided at both ends of the paper support portion 101 in the longitudinal direction. Each of the locking members 150 and 160 is generally formed in an approximately "T" shape, and has three ends. One end extends upward and forms the locking portion 161 to be described later, another end extends forward and is fitted over a rotating shaft 162 to be described later and becomes the center of rotation, and the other end extends downward and forms the coupling portion of the torsion spring 164 to be described later. These locking members 150 and 160 are rotatably fixed in a space provided between the body housing and the inner housing 110.

More specifically, each of the locking members 150 and 160 has a locking portion 161 configured to pass through the inner housing 110, to extend upward for a predetermined length, and to be exposed out of the inner housing 110. The locking portion 161 has a step protruding forward in the longitudinal direction at the top thereof, and thus, may be hooked into a locking hole (not shown) formed on the bottom surface of the cover housing. Accordingly, the locking portion 161 may perform locking so that the cover is not opened in a closed state.

Meanwhile, another end of each of the locking members 150 and 160 extends forward, is fitted to the rotating shaft 162, and is rotated. As the locking member 150 or 160 is rotated around the rotation shaft 162, the locking part 161 may move forward and backward within a predetermined range. The cover may be locked by being looked to the step formed in the locking part 161 in a state in which the locking portion 161 is fixed forward, and the cover may be opened in a state in which the locking portion 161 is moved backward.

In this case, the locking portion 161 is located within the rotation range of the push rods 141 and 142 described above. More specifically, at least a part of the movement range of the locking portions 151 and 161 is disposed to be included within the rotation range of the push rods 141 and 142. The push portions 142*b* of the push rods 141 and 142 are moved forward and backward by the rotation of the shaft 140. The push portion 142*b* and the locking portion 161 are arranged such that the locking portion 161 held at the front position may be pushed rearward by a predetermined distance when the push portion 142*b* is moved backward.

Meanwhile, the top end of the locking portion 161 has a forward slope, so that the above-described push portion 142*b* pushes the locking portion 161 rearward along the slope, and thus, the locking member 150 or 160 may be rotated. Furthermore, in the case where the cover is closed, even when the locking portion 161 is reengaged in the locking hole of the cover, the locking hole of the cover pushes the locking portion 161 rearward along the slope formed in the front side of the top end of the locking portion 161, thereby being fastened to the locking portion 161.

Furthermore, the remaining end of the locking member 150 or 160 extends downward, and forms a spring fixing portion 163, on which a torsion spring 164 is hung, on the inside thereof. A shaft extending inward is inserted into or integrated with the spring fixing portion 163, and the torsion spring 164 is hung thereon. In this case, one of the two supports of the torsion spring 164 is hung on the locking member 150 or 160, and the other one is fixed to one side of the inner housing 100. The torsion spring 164 provides elastic force so that the locking portion 161 of the locking member 150 or 160 is fixed in the state of having been moved forward. In other words, the torsion spring 164 may provide torsional force in a direction, in which the locking portion 161 is returned back to its forward position, when it is moved rearward.

Accordingly, the locking portion 161 of the locking member 150 or 160 is fastened to the locking hole formed in the cover by the force intended for the maintenance of the state of having been moved forward, and thus, the cover may be kept locked.

In this case, when the shaft 140 is rotated by the movement of the lever 130 formed on the cover, the push portions 142*b* of the push rods 141 and 142 push the locking portions 161 rearward while being moved rearward. Accordingly, the locking portion 161 is removed from the locking hole of the cover, and thus, the locking of the cover is released.

Thereafter, the locking portion 161 is moved forward by the force of the torsion spring 164 again in a state in which the cover is unlocked. When the cover is closed again, the front end of the locking hole of the cover pushes the locking portion 161 rearward along the slope formed in the front side of the top of the locking portion 161 using the external force intended to push the cover downward, and thus, the cover is closed. The locking portion 161 inserted into the cover housing through the locking hole is moved forward by the force of the torsion spring 164 again, and thus, the step of the locking portion 161 is hung on and fastened to the front side of the locking hole.

The cover and body of the printing apparatus are selectively fastened by the structure using the lever 130. Accordingly, a user may easily release the locking members 150 and 160 from a fastened state only by pulling the rear end of the lever 130 partially exposed through the rear side of the cover housing and thus rotating the shaft 140, thereby selectively opening and closing the cover.

Meanwhile, as described above, the roller 120 and the print head 170 may be arranged at corresponding positions on the body and cover of the printing apparatus. An embodiment in which a print head 170 is provided on a cover will be described as an example of a coupling structure for the print head 170.

As shown in FIGS. 10 and 11, the print head 170 has a substantially rectangular parallelepiped shape, and may include a heating element 172 extending to a width equal to or larger than the width of printing paper. The heating element 172 may be opposite to the roller 120 and be exposed through the bottom of the cover. Accordingly, the top surface of printing paper is brought into close contact with the heating element 172 by the roller 120, and thus, may be transferred while information is printed on the printing paper.

Meanwhile, a support frame 171 configured to surround and support the print head 170 from above may be installed such that the print head 170 is inserted into the bottom surface of the support frame 171 and the top surface of the support frame 171 is fixed to the cover housing. In this case, a pressing member 180 may be disposed between the support frame 171 and the cover housing. The pressing member 180 applies elastic force to the support frame 171 so that the print head 170 and the printing paper are brought into close contact with each other. In this case, the pressing member 180 may be a conventional coil spring configured to be elastically deformed in the longitudinal direction.

At least one fixing protrusion 171*a* is formed to extend upward from the top surface of the support frame 171, and the above-described pressing member 180 is fitted over the fixing protrusion 171*a*. Furthermore, one or more buffer portions 171*b* may be formed on both sides around the fixing protrusion 171*a* in the longitudinal direction on the top surface of the support frame 171. In this case, the buffer portions 171*b* protrude from the top surface of the support frame 171, and may be made of a material capable of elastic deformation, such as rubber or silicone. Although the buffer portions 171*b* may be formed in an approximately ring shape, this is not necessarily the case. They may have a different shape according to the shape or structure of a spacing portion 191 to be described later.

In this case, the pressing member 180 is not fixed directly to the cover housing, but is fixed to the cover housing through a support member 190. The support member 190 is a component configured to be inserted into the pressing member 180 and to support the support frame 171 of the print head 170 while providing elastic force to the support frame 171 of the print head 170. The support member 190 extends in a direction corresponding to the longitudinal direction of the print head 170, and is fixed to the cover housing to be movable in the longitudinal direction.

In this case, one end of the pressing member 180 is fitted over one end of the fixing protrusion 171*a* of the support frame 171, as described above. The support member 190 may include two or more fitting protrusions 192 configured to be selectively fitted into the other end of the pressing member 180 along the longitudinal direction. In this case, the two or more fitting protrusions 192 are arranged at predetermined intervals along the longitudinal direction of the support member 190 and have a predetermined height. The fitting protrusions 192 are formed to protrude downward from the base 193 of the support member 190 in a substantially cylindrical shape.

Meanwhile, in this case, the pressure between the print head 170 and the roller 120 affects print quality. Problems arise in that printing is not performed desirably and printing is blurred when the pressure is excessively low and dark printing occurs when the pressure is excessively high. Furthermore, appropriate pressure varies depending on the thickness of printing paper. Accordingly, the support member 190 needs to perform adjustment so that the appropriate printing pressure for printing paper is formed between the print head 170 and the roller 120. In addition, there may be a need to adjust the printing pressure according to the thickness of printing paper.

Accordingly, the plurality of fitting protrusions 192 formed on the above-described support member 190 is formed at different heights from the top surface of the support member 190. For this purpose, the base 193 from which the fitting protrusions 192 protrude may include a plane having steps so that the fitting protrusions 192 can have different heights along the longitudinal direction of the support member 190.

More specifically, the base 193 is formed to have a total of five steps having different heights so that the leftmost position is lowest and the height gradually increases toward the right in the embodiment shown in FIG. 10. Furthermore, one fitting protrusion 192 is formed on each of the steps, and thus, the first fitting protrusion 192 has the lowest height and the fifth fitting protrusion 192 has the highest height.

Therefore, when the pressing member 180 is fitted over the first fitting protrusion 192, the lowest pressure is applied to the support frame 171. In contrast, when the pressing member 180 is fitted over the fifth fitting protrusion 192, the gap between the fitting protrusion 192 and the fixing protrusion 171*a* is narrowest, so that the highest pressure is applied to the support frame 172. Meanwhile, the number of fitting protrusions 192 or the number of steps formed on the base 193 may vary according to an embodiment.

In this case, the support member 190 is installed to be movable in the longitudinal direction so that the fitting protrusions 192 fitted into the pressing member 180 can be selectively aligned with the longitudinal direction of the pressing member 180. For this purpose, the pressing member 180 is fitted into an adjustment rail 200, integrated with or fixedly coupled to the cover housing, to be movable in the longitudinal direction.

Furthermore, space-maintaining portions 191 extending downward for a predetermined length are disposed at both ends of the support member 190 in the longitudinal direction. The space-maintaining portions 191 extend downward for the same length at both ends, and selectively come into contact the buffer portions 171*b* formed on the top surface of the support frame 171. The space-maintaining portions 191 prevent the support frame 171 from being tilted to one side to cause pressure to be biased, and simultaneously prevent the pressing member 180 from being excessively compressed.

Meanwhile, the adjustment rail 200 may extend to cover the movement range of the support member 190, and a movement slot 201 into which the support member 190 is fitted may be formed along the longitudinal direction of the adjustment rail 200.

Therefore, the support member 190 may be moved along the movement slot 201. A user may move the support member 190 appropriately, and may selectively insert and fix the other end of the pressing member 180 over the fitting protrusion 192 that can apply appropriate pressure to the print head 170 through the pressing member 180.

Through this, appropriate pressure may be applied to the print head 170, and the user experience of allowing a user to adjust pressure according to his or her desire through an intuitive interface may be provided.

According to any one of the above-described technical solutions, there may be expected the effect of improving the durability and life span of the paper roll support device.

According to any one of the above-described technical solutions, there may be expected the effect of constructing the adjustment structure for the paper guides of the paper roll support device in a compact and simple form.

According to any one of the above-described technical solutions, there may be expected the effect of facilitating the manipulation of the support portions that are fitted into the paper tube of a paper roll in the paper roll support device.

The effects which may be acquired by the disclosed embodiments are not limited to the above-described effects, and other effects which have not been described above will be clearly understood by those having ordinary knowledge in the art, to which the disclosed embodiments pertain, from the foregoing description.

The above-described embodiments are intended merely for illustrative purposes. It will be understood that those having ordinary knowledge in the art to which the present invention pertains can easily make modifications and variations without changing the technical spirit and essential features of the present invention. Therefore, the above-described embodiments are illustrative and are not limitative in all aspects. For example, each component described as being in a single form may be practiced in a distributed form. In the same manner, components described as being in a distributed form may be practiced in an integrated form.

The scope of the present invention should be defined by the attached claims, rather than the detailed description. Furthermore, all modifications and variations which can be derived from the meanings, scope and equivalents of the claims should be construed as falling within the scope of the present invention.

What is claimed is:

1. A paper roll support device for a printing apparatus, the paper roll support device comprising:

first and second paper guides arranged to be opposite to each other, and configured to support a paper roll, in which printing paper is wound, on both sides of the paper roll;

a support panel configured to fix the first and second paper guides so that the first and second paper guides are movable in directions toward or away from each other;

first and second transfer rods installed such that first ends thereof are fixed to the first and second paper guides, respectively, and configured to be movable in conjunction with each other in such a manner that opposite rack gears are disposed on inner surfaces of the first and second transfer rods and engaged with one pinion gear;

a pulley provided to be rotatable coaxially with the pinion gear;

a belt adapted to extend a predetermined length and to be hung on an outer circumference of the pulley, installed such that one end thereof is fixed to one side of the outer circumference of the pulley and a remaining end thereof is fixed to one end of one of the first and second transfer rods, and configured to rotate the pulley; and an elastic member configured to reversely rotate the pulley to its original position by applying reverse rotational force to the pulley in a state in which the belt has rotated the pulley.

2. The paper roll support device of claim 1, wherein the elastic member comprises a torsion spring coaxially fitted to a center of the pulley, installed such that one end thereof is fixed to an outer side of the pulley and a remaining end thereof is fixed to one side of the support panel, and configured to return the pulley to its original position when external force is removed.

3. The paper roll support device of claim 2, wherein:

a first hook formed to protrude at a position spaced apart from a rotating shaft of the pulley in a radial direction by a predetermined distance and configured such that one end of the torsion spring is fixed thereto is disposed on a rear surface of the pulley; and a second hook configured such that a remaining end of the torsion spring is fixed thereto is disposed at a rear end of an extension panel extending rearward from a rear surface of the support panel.

4. The paper roll support device of claim 1, wherein:

the support panel is provided with first and second guide slots formed to pass through movement paths of the first and second paper guides, and configured to guide the first and second paper guides through their movement and to allow the first and second paper guides to be coupled to the first and second transfer rods, respectively, through the support panel; and the pinion gear is rotatably coupled to a rotating shaft extending between the first and second guide slots from a rear surface of the support panel.

5. The paper roll support device of claim 4, wherein first and second transfer rails configured such that the first and second transfer rods are fitted thereinto in a longitudinal direction and the first and second transfer rails guide the first and second transfer rods through their movement in the longitudinal direction protrude from the rear surface of the support panel in parallel with each other.

6. The paper roll support device of claim 5, wherein each of the first and second transfer rods comprises:

a head portion formed at one end of the transfer rod, and provided with a connection portion that passes through a corresponding one of the first and second guide slots, extends toward a corresponding one of the first and second paper guides, and forms a connecting portion with the corresponding paper guide; and a tail portion formed to extend inward from the head portion along a corresponding one of the transfer rails, and adapted such that a rack gear is disposed on an inner surface thereof to engage with the pinion gear at an opposite position.

7. The paper roll support device of claim 6, wherein:

the pulley is provided with a belt fixing portion configured such that the one end of the belt is fixed thereto on one side of an outer circumference of a rear surface thereof; and the belt is installed such that one end thereof is fixed to the belt fixing portion and a remaining end thereof is fixed to a head portion of one of the first and second transfer rods.

8. The paper roll support device of claim 6, wherein:

each of the first and second paper guides comprises a coupling portion fixedly coupled to a corresponding one of the connection portions at a rear end thereof in contact with the support panel, and further comprises a through hole configured such that a corresponding one of first and second support columns holding and supporting a paper tube disposed at a center of a paper roll is fixed thereinto at a front end thereof; and each of the first and second support columns comprises a body portion formed in a cylindrical shape corresponding to a shape of the through hole and fitted and fixed into the through hole, and further comprises a support portion formed to protrude from an inner surface of the body portion and configured to have a diameter smaller than a diameter of a cross section of the body portion and to have an eccentric axis deviating from a central axis of the body portion.

9. The paper roll support device of claim 8, wherein each of the first and second support columns is configured such that in a state of being partially inserted into the through hole, a movement thereof in an insertion direction is blocked to prevent it from being separated from the through hole and a movement thereof in a rotation direction is allowed and in a state of being completely inserted into the through hole, a movement thereof in the insertion direction is blocked and a movement thereof in the rotation direction is also blocked.

10. The paper roll support device of claim 9, wherein:

an outer circumferential surface of the body portion of each of the first and second support columns is provided with a first stop protrusion having a step at a predetermined height along an outer circumference of the support column in the insertion direction, a second stop protrusion having a step at the outer end along the outer circumference of the support column in the insertion direction, and a third stop protrusion having a step at a predetermined height in the rotation direction; and an inner circumferential surface of the through hole is provided with a catch protrusion formed at a predetermined height along the inner circumference and configured such that the first and second stop protrusions are selectively caught thereon, and a protrusion seating portion configured to block rotation of the body portion in such a manner that the third stop protrusion is seated in the protrusion seating portion when the first stop protrusion is caught on the catch protrusion.

11. The paper roll support device of claim 10, wherein the protrusion seating portion comprises two or more protrusion seating portions formed at positions that allow the third stop protrusion to be fitted into one of the protrusion seating portions in a state in which the eccentric axis of the support portion is selectively disposed at one of positions closest to or farthest from a preset fixed position near the through hole.

12. The paper roll support device of claim 8, wherein each of the first and second support columns is configured such that in a state of being inserted into the through hole, a movement thereof in an insertion direction is blocked to prevent it from being separated from the through hole and a movement thereof in a rotation direction is selectively blocked.

13. The paper roll support device of claim 12, wherein:

each of the first and second support columns is provided with a stop protrusion configured to have a step in the insertion direction along an outer circumference at an outer end of an outer circumferential surface of the body portion, and is further provided with a groove formed by a pair of bumps protruding from an inner circumferential surface of the body portion and extending in the insertion direction in parallel with each other;

the through hole is provided with a catch protrusions formed to protrude along an inner circumference of the through hole at a predetermined height and configured such that the stop protrusion is caught thereon, and is further provided with a latch formed in a cantilever shape in which the latch extends outward from the inner circumferential surface of the through hole on an outer side of the through hole in the insertion direction and an outer end of the latch is vertically bent toward a central axis of the through hole; and a bent portion of the latch is provided with a protruding portion formed to extend toward an inner side of the through hole and configured to selectively block a movement of the support column in the rotation direction by being fitted into the groove.

14. The paper roll support device of claim 13, wherein the groove comprises two or more grooves formed at positions that allow the protruding portion to be fitted into one of the grooves in a state in which the eccentric axis of the support portion is selectively disposed at one of positions closest to or farthest from a preset fixed position near the through hole.

15. The paper roll support device of claim 5, wherein:

the first and second guide slots are arranged alongside each other to be symmetrical on both sides of a center of the support panel in a longitudinal direction of the support panel;

one of the first and second transfer rails is disposed above the first and second guide slots in parallel with the first and second guide slots; and a remaining one of the first and second transfer rails is disposed below the first and second guide slots in parallel with the first and second guide slots.

16. A printing apparatus comprising the paper roll support device of claim 1.

* * * * *